US009862179B2

(12) United States Patent
Hill et al.

(10) Patent No.: US 9,862,179 B2
(45) Date of Patent: Jan. 9, 2018

(54) WEB TRANSPORT SYSTEM INCLUDING SCAVENGER BLADE

(71) Applicant: Eastman Kodak Company, Rochester, NY (US)

(72) Inventors: Kelvin P. Hill, Rochester, NY (US); Robert R. Bettin, Rochester, NY (US); James Douglas Shifley, Spencerport, NY (US); Timothy John Young, Williamson, NY (US); Gary P. Wainwright, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 89 days.

(21) Appl. No.: 14/812,078

(22) Filed: Jul. 29, 2015

(65) Prior Publication Data

US 2017/0028706 A1 Feb. 2, 2017

(51) Int. Cl.
*B05C 11/04* (2006.01)
*B41F 21/00* (2006.01)
(Continued)

(52) U.S. Cl.
CPC ..... *B41F 21/00* (2013.01); *B05C 3/125* (2013.01); *B05C 11/04* (2013.01); *B05C 11/048* (2013.01); *B65H 16/023* (2013.01); *B65H 16/06* (2013.01); *B65H 20/14* (2013.01); *B65H 23/048* (2013.01); *B65H 23/1806* (2013.01); *B65H 23/24* (2013.01); *B65H 37/00* (2013.01); *C23C 18/163* (2013.01); *C23C 18/1632* (2013.01); *B05C 5/0245* (2013.01); *B05C 11/1039* (2013.01); *B05D 1/18* (2013.01); *B05D 1/28* (2013.01); *B05D 1/42* (2013.01); *B05D 2252/00* (2013.01); *C23C 18/1651* (2013.01); *C23C 18/38* (2013.01); *C23C 18/42* (2013.01)

(58) Field of Classification Search
None
See application file for complete search history.

(56) References Cited

U.S. PATENT DOCUMENTS 4,332,840 A 6/1982 Tanaka et al.
5,284,520 A 2/1994 Tarnaka
(Continued)

FOREIGN PATENT DOCUMENTS

WO 2009/044124 1/2009
WO WO 2009/044124 4/2009
WO 2013/063188 5/2013

*Primary Examiner* — Joshua D Zimmerman
(74) *Attorney, Agent, or Firm* — Kevin E. Spaulding

(57) ABSTRACT

A web transport system for transporting a web of media along a web-transport path including a fluid bar for guiding the web of media, and a scavenger blade positioned downstream of the fluid bar. A liquid is pumped through holes in an exterior bearing surface of the fluid bar, thereby pushing the web of media away from the fluid bar. The scavenger bar includes a blade edge facing the first surface of the web of media, the blade edge being spaced apart from the first surface of the web of media by a gap distance. The scavenger blade removes at least some liquid from the first surface of the web of media as it passes by the scavenger blade, thereby reducing the amount of liquid that is carried along to portions of the web-transport path that are downstream of the scavenger blade.

16 Claims, 18 Drawing Sheets

(51) Int. Cl.

| | |
|---|---|
| ***B65H 16/02*** | (2006.01) |
| ***B65H 16/06*** | (2006.01) |
| ***B65H 20/14*** | (2006.01) |
| ***B65H 23/04*** | (2006.01) |
| ***B65H 23/18*** | (2006.01) |
| ***B65H 37/00*** | (2006.01) |
| ***C23C 18/16*** | (2006.01) |
| ***B65H 23/24*** | (2006.01) |
| ***B05C 3/12*** | (2006.01) |
| *B05C 5/02* | (2006.01) |
| *B05C 11/10* | (2006.01) |
| *B05D 1/28* | (2006.01) |
| *C23C 18/38* | (2006.01) |
| *C23C 18/42* | (2006.01) |
| *B05D 1/18* | (2006.01) |
| *B05D 1/42* | (2006.01) |

(56) References Cited

U.S. PATENT DOCUMENTS

| | | | | |
|---|---|---|---|---|
| 5,353,979 | A | 10/1994 | Gartmann | |
| 2003/0175430 | A1* | 9/2003 | Tomaru | B05C 5/0254 427/356 |
| 2013/0192757 | A1 | 8/2013 | Lymn | |
| 2015/0014173 | A1* | 1/2015 | Lapelosa | C25D 5/022 205/52 |

* cited by examiner

WEB TRANSPORT SYSTEM INCLUDING SCAVENGER BLADE

CROSS-REFERENCE TO RELATED APPLICATIONS

Reference is made to commonly-assigned, co-pending U.S. patent application Ser. No. 14/812,119, entitled "Web transport system including fluid guide" by R. Bettin et al.; and to commonly-assigned, co-pending U.S. patent application Ser. No. 14/812,140, entitled "Electroless plating system including bubble guide" by R. Bettin et al., each of which is incorporated herein by reference.

FIELD OF THE INVENTION

This invention pertains to the field of web transport systems that include a fluid bar, and more particularly to an arrangement for reducing the amount of liquid that is transported to downstream or upstream portions of the web-transport path.

BACKGROUND OF THE INVENTION

Processing a web of media in roll-to-roll fashion can be an advantageous and low-cost manufacturing approach for devices or other objects formed on the web of media. A number of manufacturing methods, such as etching, plating, developing, or rinsing include processing the media in a tank of liquid chemicals. Transporting the web of media through the liquid chemicals can provide technical challenges, especially if rollers are used to guide the web of media, as is conventionally done. An example of a process that includes web transport through liquid chemicals is roll-to-roll electroless plating.

Electroless plating, also known as chemical or autocatalytic plating, is a plating process that involves chemical reactions in an aqueous plating solution that occur without the use of external electrical power. Typically, the plating occurs as hydrogen is released by a reducing agent and oxidized, thus producing a negative charge on the surface of the part to be plated. The negative charge attracts metal ions out of the plating solution to adhere as a metalized layer on the surface. Using electroless plating to provide metallization in predetermined locations can be facilitated by first depositing a catalytic material in the predetermined locations. This can be done, for example, by printing features using an ink containing a catalytic component.

Touch screens are visual displays with areas that may be configured to detect both the presence and location of a touch by, for example, a finger, a hand or a stylus. Touch screens may be found in many common devices such as televisions, computers, computer peripherals, mobile computing devices, automobiles, appliances and game consoles, as well as in other industrial, commercial and household applications. A capacitive touch screen includes a substantially transparent substrate which is provided with electrically conductive patterns that do not excessively impair the transparency—either because the conductors are made of a material, such as indium tin oxide, that is substantially transparent, or because the conductors are sufficiently narrow that the transparency is provided by the comparatively large open areas not containing conductors. For capacitive touch screens having metallic conductors, it is advantageous for the features to be highly conductive but also very narrow. Capacitive touch screen sensor films are an example of an article having very fine features with improved electrical conductivity resulting from an electrolessly-plated metal layer.

Projected capacitive touch technology is a variant of capacitive touch technology. Projected capacitive touch screens are made up of a matrix of rows and columns of conductive material that form a grid. Voltage applied to this grid creates a uniform electrostatic field, which can be measured. When a conductive object, such as a finger, comes into contact, it distorts the local electrostatic field at that point. This is measurable as a change in capacitance. The capacitance can be measured at every intersection point on the grid. In this way, the system is able to accurately track touches. Projected capacitive touch screens can use either mutual capacitive sensors or self capacitive sensors. In mutual capacitive sensors, there is a capacitor at every intersection of each row and each column. A 16×14 array, for example, would have 224 independent capacitors. A voltage is applied to the rows or columns. Bringing a finger or conductive stylus close to the surface of the sensor changes the local electrostatic field which reduces the mutual capacitance. The capacitance change at every individual point on the grid can be measured to accurately determine the touch location by measuring the voltage in the other axis. Mutual capacitance allows multi-touch operation where multiple fingers, palms or styli can be accurately tracked at the same time.

WO 2013/063188 by Petcavich et al. discloses a method of manufacturing a capacitive touch sensor using a roll-to-roll process to print a conductor pattern on a flexible transparent dielectric substrate. A first conductor pattern is printed on a first side of the dielectric substrate using a first flexographic printing plate and is then cured. A second conductor pattern is printed on a second side of the dielectric substrate using a second flexographic printing plate and is then cured. The ink used to print the patterns includes a catalyst that acts as seed layer during subsequent electroless plating. The electrolessly-plated material (e.g., copper) provides the low resistivity in the narrow lines of the grid needed for excellent performance of the capacitive touch sensor. Petcavich et al. indicate that the line width of the flexographically-printed material can be 1 to 50 microns.

Flexography is a method of printing or pattern formation that is commonly used for high-volume printing runs. It is typically employed in a roll-to-roll format for printing on a variety of soft or easily deformed materials including, but not limited to, paper, paperboard stock, corrugated board, polymeric films, fabrics, metal foils, glass, glass-coated materials, flexible glass materials and laminates of multiple materials. Coarse surfaces and stretchable polymeric films are also economically printed using flexography.

Flexographic printing members are sometimes known as relief printing members, relief-containing printing plates, printing sleeves, or printing cylinders, and are provided with raised relief images onto which ink is applied for application to a printable material. While the raised relief images are inked, the recessed relief "floor" should remain free of ink.

Although flexographic printing has conventionally been used in the past for printing of images, more recent uses of flexographic printing have included functional printing of devices, such as touch screen sensor films, antennas, and other devices to be used in electronics or other industries. Such devices typically include electrically conductive patterns.

To improve the optical quality and reliability of the touch screen, it has been found to be preferable that the width of the grid lines be approximately 2 to 10 microns, and even more preferably to be 4 to 8 microns. In addition, in order to be compatible with the high-volume roll-to-roll manufacturing process, it is preferable for the roll of flexographically printed material to be electroless plated in a roll-to-roll electroless plating system. More conventionally, electroless plating is performed by immersing the item to be plated in a tank of plating solution. However, for high volume uniform plating of features on both sides of the web of substrate material, it is preferable to perform the electroless plating in a roll-to-roll electroless plating system.

Patterns, especially fine line patterns that are plated using electroless plating systems, are often delicate and susceptible to being damaged as the web of substrate is transported along the web-transport path. For example, particulates can be located on the media support surface of a roller that contacts the web surface and cause scratches as the web of media passes. Therefore it is desirable to minimize contact between the web of media and hard surfaces where abrasion may occur.

WO 2009/044124 to Lymn, entitled "Web processing machine," discloses a web transport system using submerged fluid bearings in which process liquid is directed through apertures to lift the web of media away from the bearing surface. In Lymn's preferred embodiment, it is contemplated that non-submerged upper web guides that are located above the liquid level can also use fluid bearings where air is used as the fluid. However, Lymn also contemplates using process liquid in place of air in a non-submerged upper web. U.S. Patent Application Publication 2013/0192757 to Lymn, also entitled "Web processing machine," describes a similar configuration.

Roll-to-roll electroless plating systems are susceptible to the formation of plating artifacts when gas bubbles come into contact with the web of substrate during the plating process. The gas bubbles can block plating solution from contacting the web of media, thereby preventing the plating process from depositing the plating substance onto the blocked portions of the web of media.

U.S. Pat. No. 5,284,520 to A. Tanaka, entitled "Electroless plating device," discloses a shield plate having perforations positioned between an object being plated and a pipe that injects gas bubbles into the plating solution for stabilizing the plating chemistry. The shield plate allows plating solution to pass, but prevents gas bubbles from passing through the shield plate and collecting on the object.

There remains a need for improved electroless plating systems, including improved web transport systems that can reduce the occurrence of scratches, and improved arrangements that prevent the formation of bubble-related artifacts.

SUMMARY OF THE INVENTION

The present invention represents a web transport system for transporting a web of media along a web-transport path, comprising:

a fluid bar disposed along the web-transport path, the web of media being guided as it passes the fluid bar with a first surface of the web of media facing an exterior bearing surface of the fluid bar, wherein a liquid is pumped through holes in the bearing surface of the fluid bar and into a region between the first surface of the web of media and the bearing surface of the fluid bar, thereby pushing the web of media away from the fluid bar, and wherein the fluid bar is not submerged in a liquid; and a scavenger blade disposed along the web-transport path downstream of the fluid bar, the scavenger blade spanning the web of media in a cross-track direction and including a blade edge facing the first surface of the web of media, the blade edge being spaced apart from the first surface of the web of media by a gap distance, wherein the scavenger blade removes at least some liquid from the first surface of the web of media as it passes by the scavenger blade, thereby reducing the amount of liquid that is carried along to portions of the web-transport path that are downstream of the scavenger blade.

This invention has the advantage that the scavenger blade prevents the liquid from being carried downstream where it would contaminate other processing operations.

It has the additional advantage that it prevents the loss of expensive processing liquids by redirecting the liquid removed from the web of media back into an associated processing tank.

Figure 1:
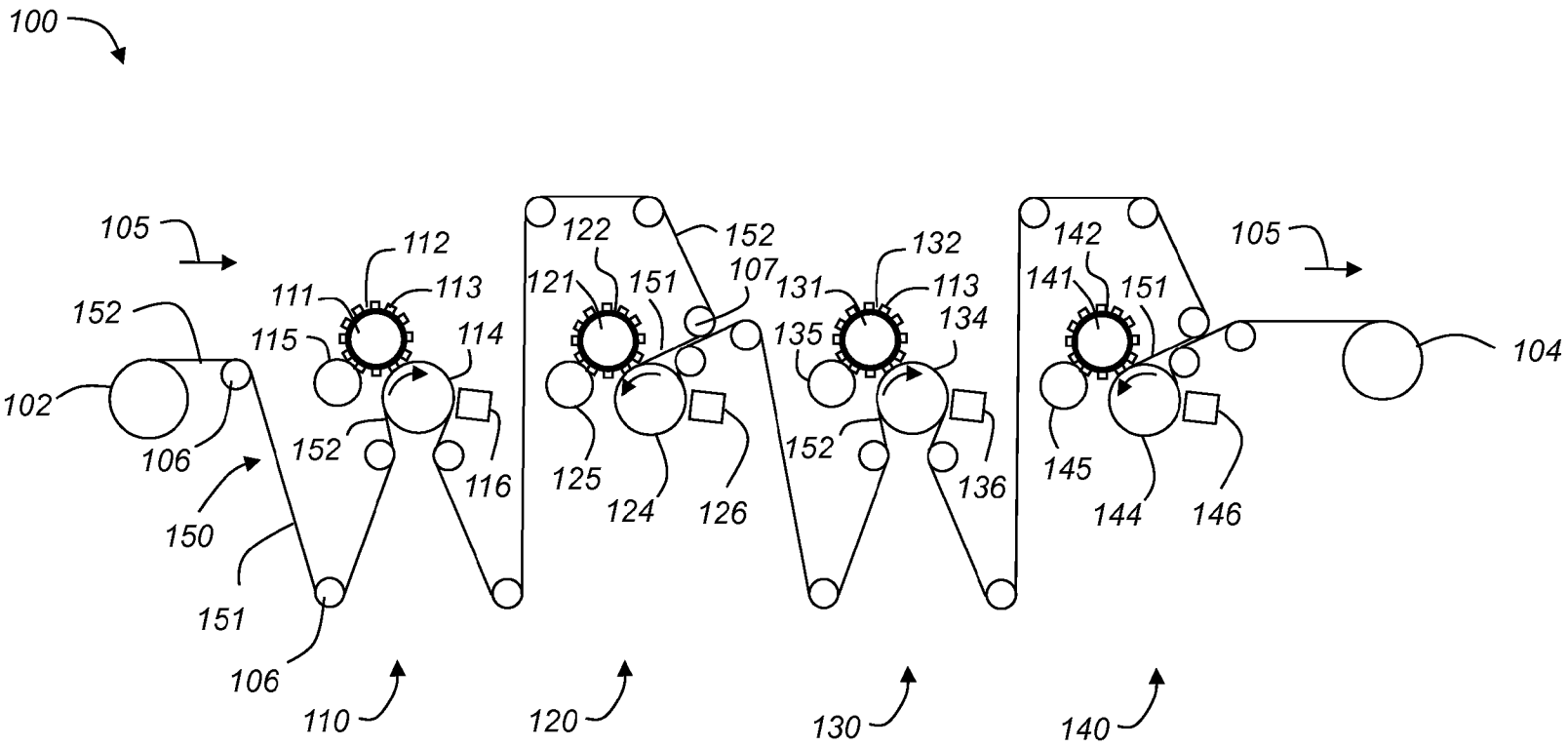
FIG. 1 is a schematic side view of a flexographic printing system for roll-to-roll printing on both sides of a substrate.

It is to be understood that the attached drawings are for purposes of illustrating the concepts of the invention and may not be to scale.

DETAILED DESCRIPTION OF THE INVENTION

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. It should be noted that, unless otherwise explicitly noted or required by context, the word "or" is used in this disclosure in a non-exclusive sense.

The example embodiments of the present invention are illustrated schematically and not to scale for the sake of clarity. One of ordinary skill in the art will be able to readily determine the specific size and interconnections of the elements of the example embodiments of the present invention.

References to upstream and downstream herein refer to direction of flow. Web media moves along a media path in a web advance direction from upstream to downstream. Similarly, fluids flow through a fluid line in a direction from upstream to downstream. In some instances a fluid can flow in an opposite direction from the web advance direction. For clarification herein, upstream and downstream are meant to refer to the web motion unless otherwise noted.

As described herein, the example embodiments of the present invention provide a roll-to-roll electroless plating system for providing web transport without contacting the surface of the web with a hard surface such as a roller. The roll-to-roll electroless plating system is useful for metalizing printed features in sensor films incorporated into touch screens. However, many other applications are emerging for printing and electroless plating of functional devices that can be incorporated into other electronic, communications, industrial, household, packaging and product identification systems (such as RFID) in addition to touch screens. In addition, roll-to-roll electroless plating systems can be used to plate items for decorative purposes rather than electronic purposes and such applications are contemplated as well. Furthermore, there are many other applications of liquid processing of a web of media in a roll-to-roll configuration in addition to electroless plating.

FIG. 1 is a schematic side view of a flexographic printing system 100 that can be used in embodiments of the invention for roll-to-roll printing of a catalytic ink on both sides of a substrate 150 for subsequent electroless plating. Substrate 150 is fed as a web from supply roll 102 to take-up roll 104 through flexographic printing system 100. Substrate 150 has a first side 151 and a second side 152.

The flexographic printing system 100 includes two print modules 120 and 140 that are configured to print on the first side 151 of substrate 150, as well as two print modules 110 and 130 that are configured to print on the second side 152 of substrate 150. The web of substrate 150 travels overall in roll-to-roll direction 105 (left to right in the example of FIG. 1). However, various rollers 106 and 107 are used to locally change the direction of the web of substrate as needed for adjusting web tension, providing a buffer, and reversing the substrate 150 for printing on an opposite side. In particular, note that in print module 120 roller 107 serves to reverse the local direction of the web of substrate 150 so that it is moving substantially in a right-to-left direction.

Each of the print modules 110, 120, 130, 140 includes some similar components including a respective plate cylinder 111, 121, 131, 141, on which is mounted a respective flexographic printing plate 112, 122, 132, 142, respectively. Each flexographic printing plate 112, 122, 132, 142 has raised features 113 defining an image pattern to be printed on the substrate 150. Each print module 110, 120, 130, 140 also includes a respective impression cylinder 114, 124, 134, 144 that is configured to force a side of the substrate 150 into contact with the corresponding flexographic printing plate 112, 122, 132, 142. Impression cylinders 124 and 144 of print modules 120 and 140 (for printing on first side 151 of substrate 150) rotate counter-clockwise in the view shown in FIG. 1, while impression cylinders 114 and 134 of print modules 110 and 130 (for printing on second side 152 of substrate 150) rotate clockwise in this view.

Each print module 110, 120, 130, 140 also includes a respective anilox roller 115, 125, 135, 145 for providing ink to the corresponding flexographic printing plate 112, 122, 132, 142. As is well known in the printing industry, an anilox roller is a hard cylinder, usually constructed of a steel or aluminum core, having an outer surface containing millions of very fine dimples, known as cells. Ink is provided to the anilox roller by a tray or chambered reservoir (not shown). In some embodiments, some or all of the print modules 110, 120, 130, 140 also include respective UV curing stations 116, 126, 136, 146 for curing the printed ink on substrate 150.

Figure 2:
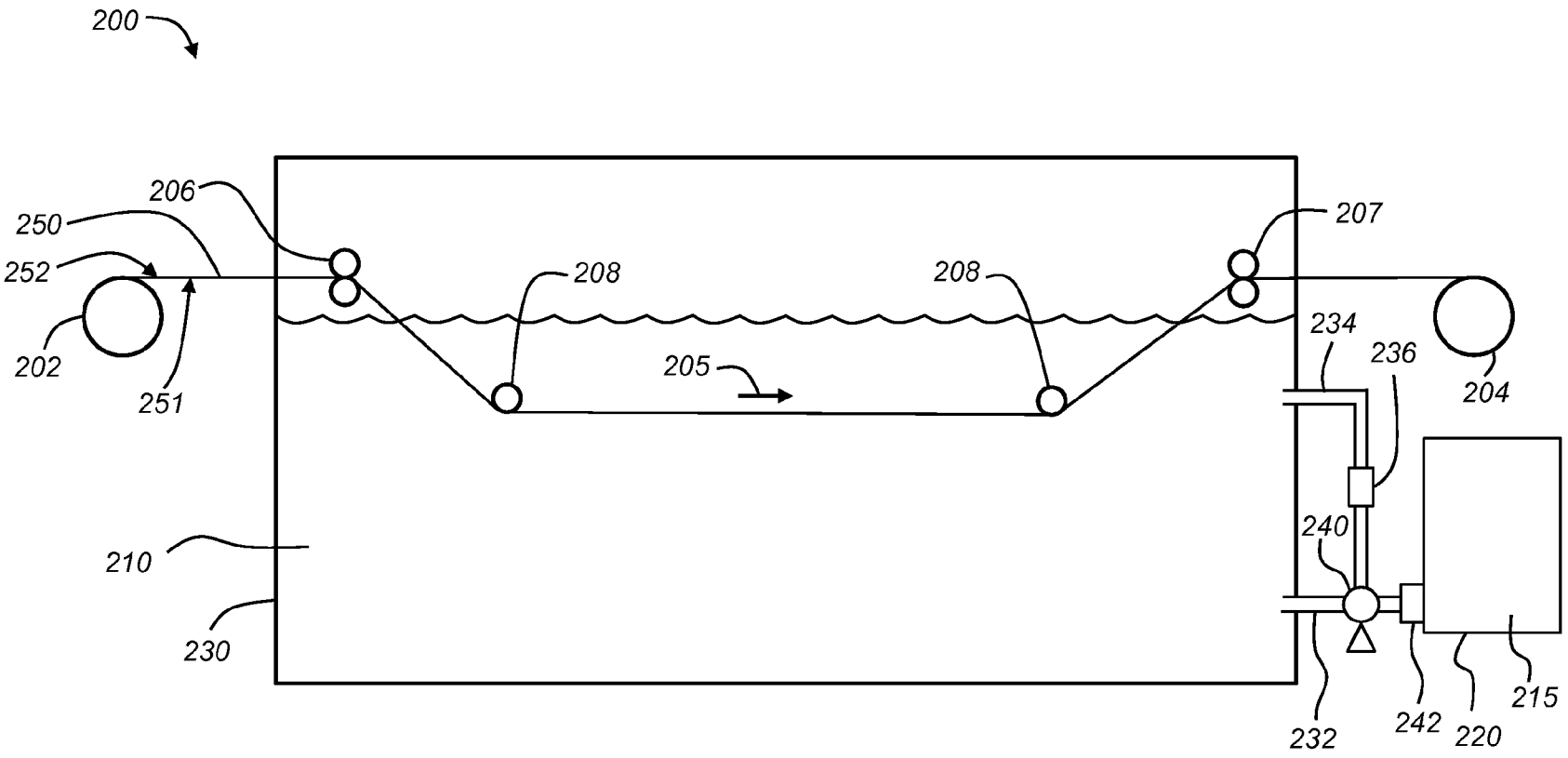
FIG. 2 (Prior Art)
FIG. 2 is a schematic side view of a roll-to-roll electroless plating system.

FIG. 2 is a schematic side view of a roll-to-roll electroless plating system 200 disclosed in commonly-assigned, co-pending U.S. patent application Ser. No. 14/571,328 entitled "Roll-to-roll electroless plating system with liquid flow bearing," by S. Reuter et al., which is incorporated herein by reference. The roll-to-roll electroless plating system 200 includes a tank 230 of plating solution 210. Web of media 250 is fed by a web advance system along a web-transport path in an in-track direction 205 from a supply roll 202 to a take-up roll 204. The web of media 250 is a substrate upon which electroless plating is to be performed. Drive roller 206 is positioned upstream of the plating solution 210 and drive roller 207 is positioned downstream of the plating solution 210. Drive rollers 206 and 207 advance the web of media 250 from the supply roll 202 through the tank of plating solution 210 to the take-up roll 204. Web-guiding rollers 208 are at least partially submerged in the plating solution 210 in the tank 230 and guide the web of media 250 along the web-transport path in the in-track direction 205.

As the web of media 250 is advanced through the plating solution 210 in the tank 230, a metallic plating substance such as copper, silver, gold, nickel or palladium is electrolessly plated from the plating solution 210 onto predetermined locations on one or both of a first surface 251 and a second surface 252 of the web of media 250. As a result, the concentration of the metal or other components in the plating solution 210 in the tank 230 decreases and the plating solution 210 needs to be refreshed. To refresh the plating solution 210, it is recirculated by pump 240, and replenished plating solution 215 from a reservoir 220 is added under the control of controller 242, which can include a valve (not shown). In the example shown in FIG. 2, plating solution 210 is moved from tank 230 to pump 240 through a drain pipe 232 and is returned from pump 240 to tank 230 through a return pipe 234. In order to remove particulates from plating solution 210, a filter 236 can be included, typically downstream of the pump 240.

Particulates can be present in plating solution 210 due to contaminants that enter from outside of the tank 230, or can be generated from hardware within tank 230, or can result from spontaneous plating out of metal from the electroless plating solution 210. Particulates that settle on the bottom of the tank 230 are not a problem. However, particulates that fall onto the web of media 250 and become trapped between web of media 250 and one of the drive rollers 206, 207 or web-guiding rollers 208 can cause significant problems due to scratching of the delicate patterns formed on the web of media 250. In some cases, a particulate can become embedded in a roller and cause scratches in successive portions of the web of media 250 that contact it.

As described above, WO 2009/044124 to Lymn, entitled "Web processing machine," discloses a web transport system using submerged fluid bearings in which process liquid is directed through apertures to force the web of media away from the bearing surface. In Lymn's preferred embodiment it is contemplated that non-submerged upper web guides that are located above the liquid level can also use fluid bearings where air is used as the fluid, but Lymn also contemplates using process liquid in place of the air in the non-submerged web guides. However, Lymn does not address the problems that can occur when ejecting liquid through apertures of a non-submerged web guide.

Figure 3:
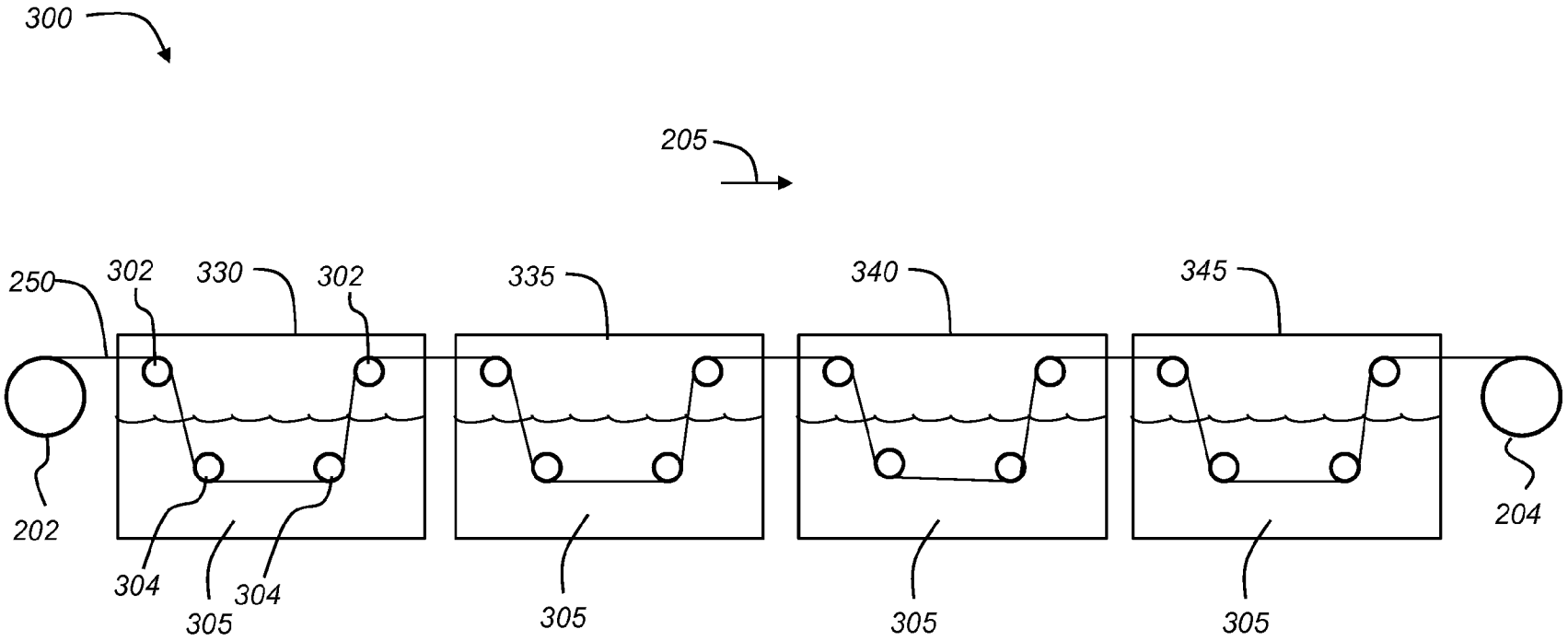
FIG. 3 is a schematic side view of a multi-stage roll-to-roll liquid processing system.

A roll-to-roll liquid processing system 300 for processing a web of media 250 can have a plurality of processing tanks 330, 335, 340, 345 between the supply roll 202 and the take-up roll 204, as shown schematically in FIG. 3. Each successive processing tank 330, 335, 340, 345, can contain a different processing liquid 305, and web of media 250 is successively transported through the processing tanks between the supply roll 202 and the take-up roll 204. If roll-to-roll liquid processing system 300 is an electroless plating line for plating touch screen sensor films on catalytic ink patterns printed by flexographic printing system 100 of FIG. 1, the processing tanks 330, 340 can be plating tanks containing plating solution and the processing tanks 335, 345 can be rinse tanks containing a rinsing liquid. For example, the processing liquid 305 in processing tank 330 can be a copper plating solution; the processing liquid 305 in processing tank 335 can be water for rinsing the web of media 250; the processing liquid 305 in processing tank 340 can be a palladium plating solution; and the processing liquid 305 in processing tank 345 can be water for rinsing the web of media 250. The web of media 250 is transported along in-track direction 205 into each successive processing tank 330, 335, 340, 345, submerged in its processing liquid 305, and then transported out of the processing tank 330, 335, 340, 345 and into the next processing tank 330, 335, 340, 345, and finally to the take-up roll 204. Web transport guides for each tank include both non-submerged web guides 302 and submerged web guides 304.

Embodiments of the invention solve problems that can occur when using a non-submerged web guide 302 where liquid is forced through holes in an exterior bearing surface of the non-submerged web guide 302 to act as a fluid bearing so that the web of media 250 does not contact the bearing surface of the non-submerged web guide 302. Problems including fluid containment and air entrainment, for example, can arise due to the ejection of liquid at high velocity from a non-submerged web guide 302.

Figure 4:
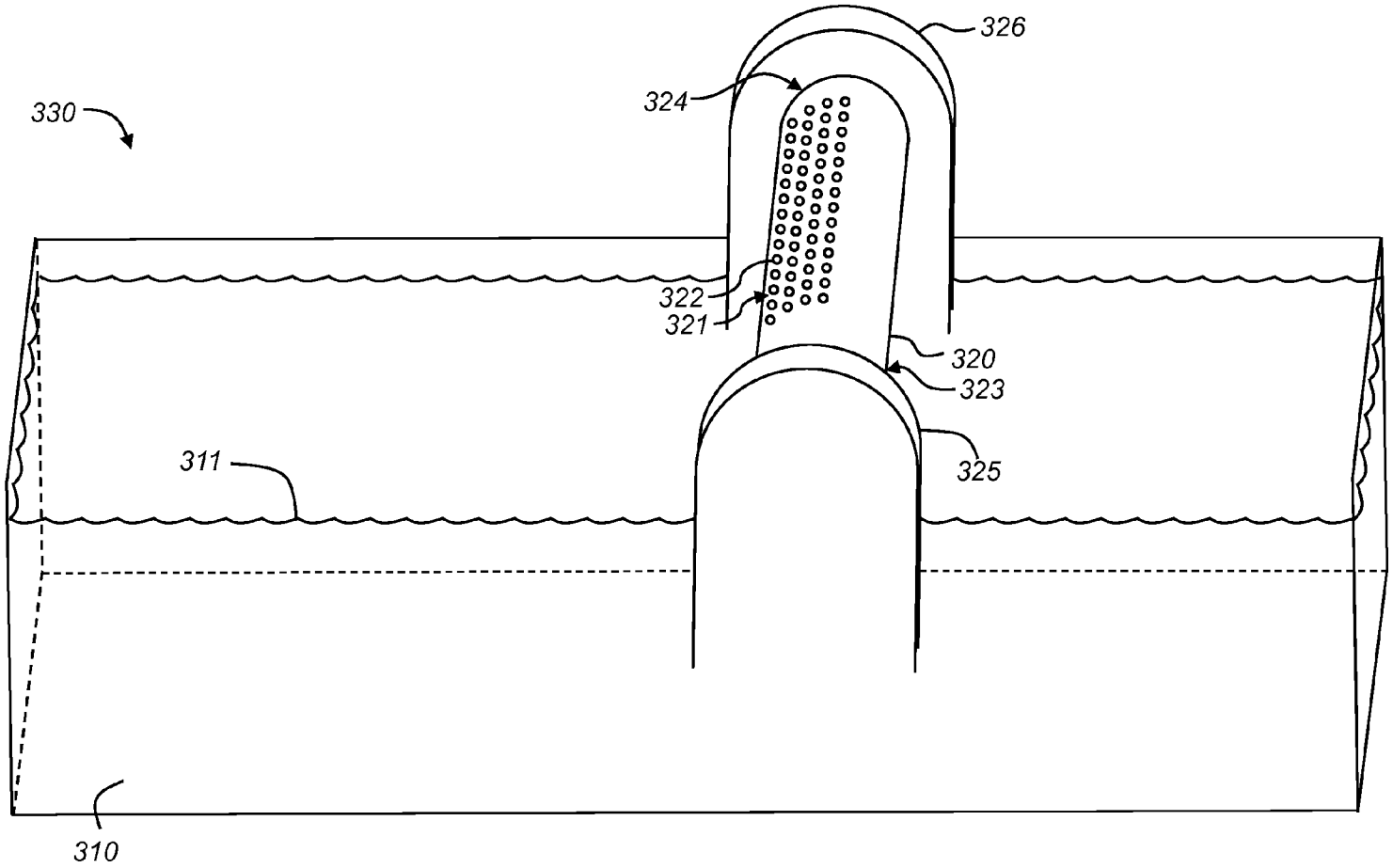
FIG. 4 a cutaway perspective of a plating tank including a non-submerged fluid bar.

FIG. 4 is a cutaway perspective of a processing tank 330 including a processing liquid 310 (e.g., a plating solution) that has a liquid level 311. A non-contact web guide, also called a fluid bar 320 herein, has an exterior bearing surface 321 having an array of holes 322. Typically, bearing surface 321 has a smooth arc-shaped cross-section. Fluid bar 320 is supported at its first end 323 by a first mount 325, and at its second end 324 by a second mount 326. Processing liquid 310 is forced through the holes 322 by a pump (not shown). Fluid bar 320 can have a hollow chamber or manifold (not shown) in its interior that is in fluidic communication with the holes 322. Processing liquid 310 can be supplied to the manifold through appropriate plumbing (not shown) between the pump and the manifold. In some configurations, the plumbing can be adjacent to or within one or both of the first mount 325 and the second mount 326.

As can be seen in FIG. 3, the holes 322 in the fluid bar 320 are above the liquid level 311. Although other portions of the fluid bar 320 may or may not be above liquid level 311, the holes are above liquid level 311. In the terminology used herein, a fluid bar 320 is said to be "non-submerged" if at least some of the holes 322 in the bearing surface 321 through with processing liquid 310 is ejected are above liquid level 311.

Figure 5:
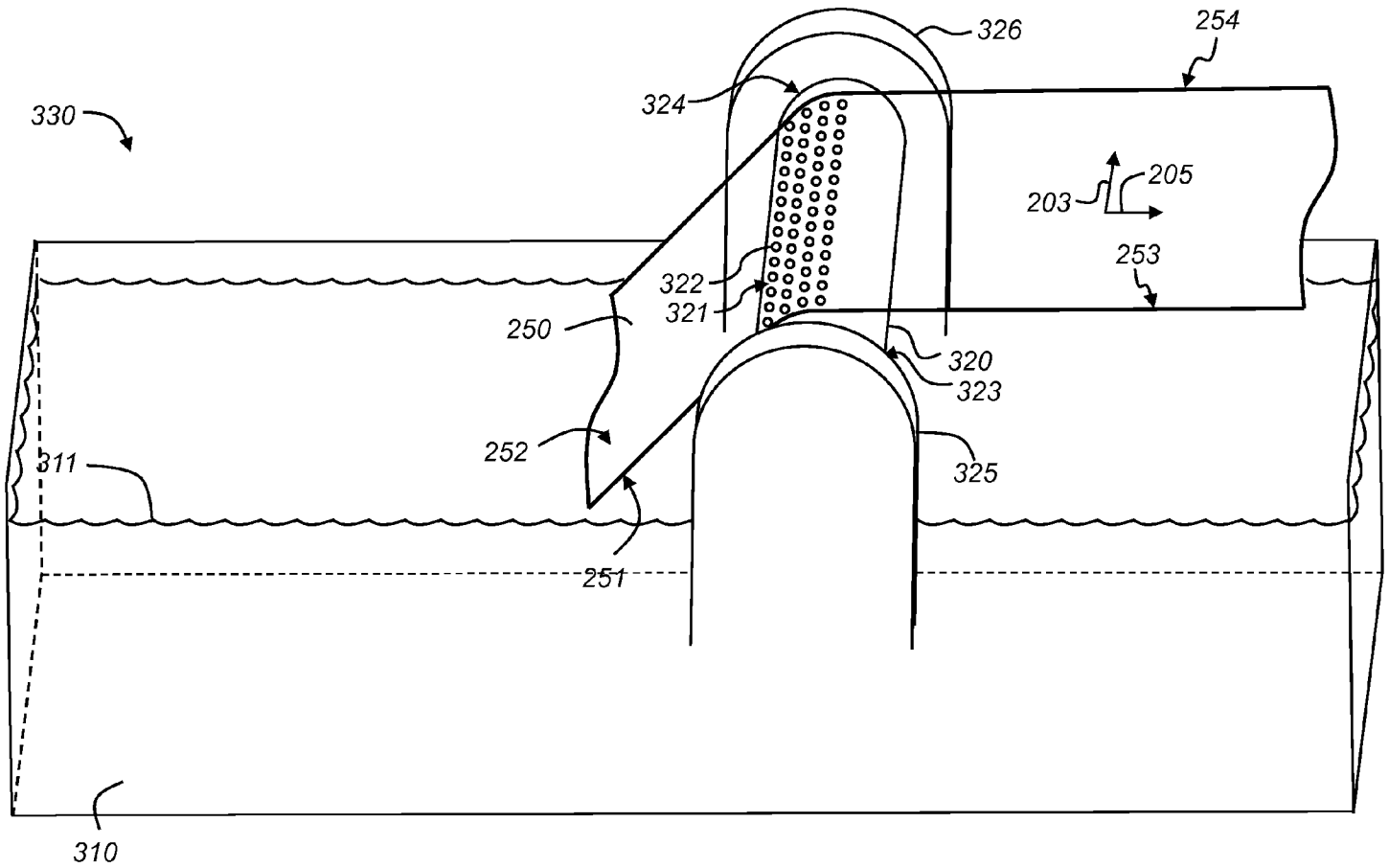
FIG. 5 shows a portion of a web of media being guided around the non-submerged fluid bar of FIG. 4.

FIG. 5 shows a web of media 250 being guided around and past the non-submerged fluid bar 320 of FIG. 4. The web of media 250 travels in an in-track direction 205 and extends width-wise in a cross-track direction 203 from a first edge 253 to a second edge 254. The web of media 250 has a first surface 251 and an opposing second surface 252, where the first surface 251 faces the exterior bearing surface 321 of the fluid bar 320. The bearing surface 321 is defined to be the portion of the exterior surface of the fluid bar 320 around which the web of media 250 is wrapped. The fluid bar 320 spans the width of the web of media 250. As processing liquid 310 is pumped through the holes 322 in the bearing surface 321 into a region between the first surface 251 of the web of media 250 and the bearing surface 321 of the fluid bar 320, the web of media 250 is pushed away from the fluid bar 320. This allows guiding of the web of media 250 without touching or scratching it by contact with the fluid bar 320.

An advantage of pumping liquid processing solution such as processing liquid 310 through the holes 322 instead of air as contemplated by Lymn (WO 2009/044124) in his preferred embodiment, is that the forced air can tend to dry the processing liquid 310 in a non-uniform fashion on the web of media 250. By contrast, pumping processing liquid 310 through holes 322 in fluid bar 320 allows the web of media 250 not to dry completely before exiting the processing tank 330 and entering the next processing stage (e.g., processing tank 335 in the example shown of FIG. 3). The ejected liquid processing solution can also help to clean the web of media 250 by removing particulates from the first surface 251 of the web of media 250.

Figure 6:
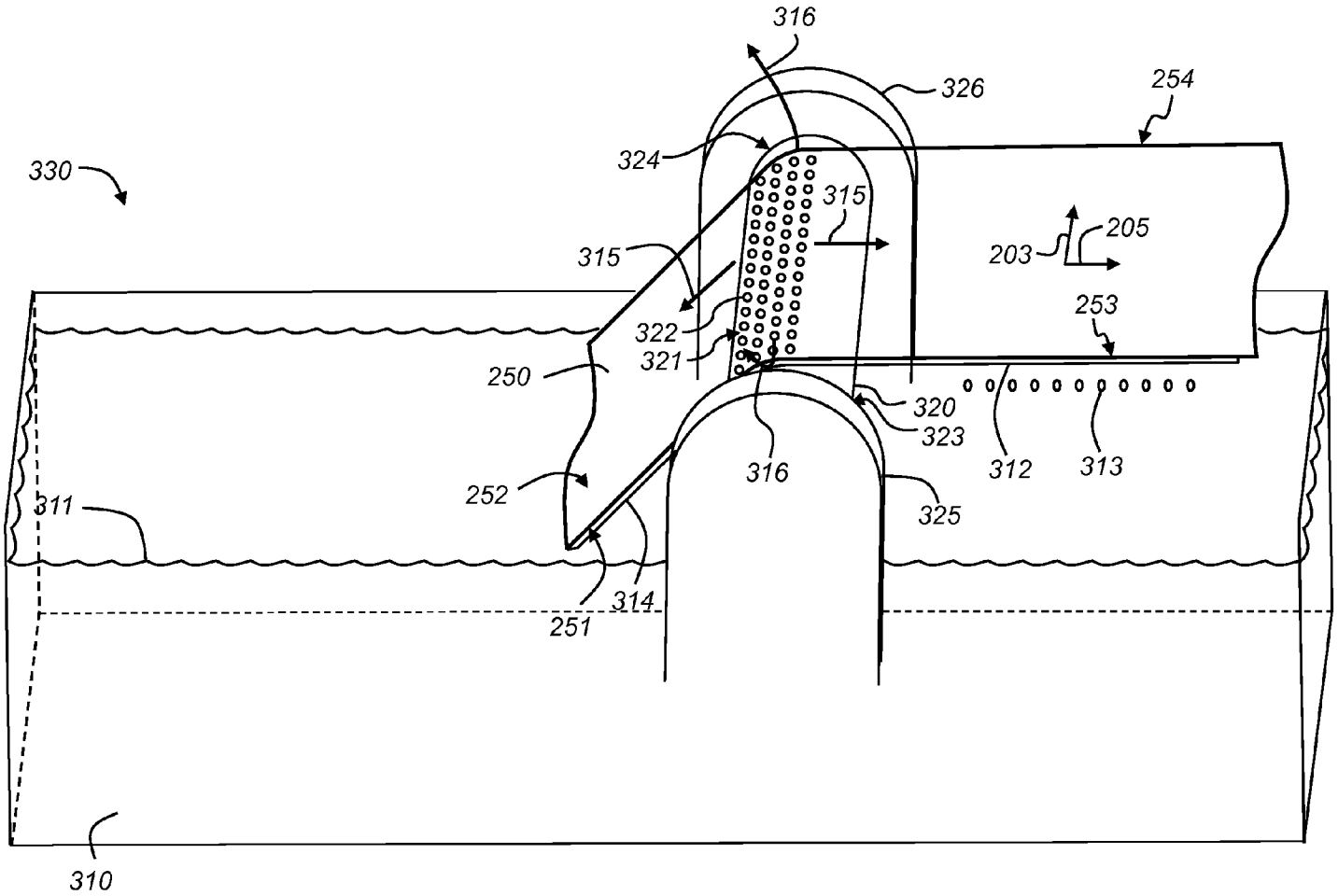
FIG. 6 shows liquid deflected by the web of media of FIG. 5.

FIG. 6 is similar to FIG. 5 and illustrates several problems that can occur when ejecting a liquid processing solution through a non-submerged fluid bar 320. The processing solution exits the regions between the fluid bar 320 and the web of media 250 as deflected liquid 315, 316. A first problem is that deflected liquid 315 is deflected along the web of media 250 both upstream and downstream in terms of the direction of motion of the web of media 250. Some of the deflected liquid 315 forms a sheet of liquid 314 that is directed by the web of media 250 back into the processing liquid 310. In addition, some of the deflected liquid 315 forms a sheet of liquid 312 that adheres to first surface 251 of web of media 250 and is carried toward the exit of processing tank 330. Some of the sheet of liquid 312 falls as drips 313 back into the processing liquid 310 in processing tank 330. However, a significant amount of processing liquid 310 in the sheet of liquid 312 can exit the processing tank 330 and be carried into downstream processing components. This wastes processing liquid 310, and also contaminates the solutions used in the subsequent processing operations. Although copper plating solution is moderately expensive, palladium plating solution is quite expensive, and any waste is unacceptable.

A second problem illustrated by FIG. 6 is that processing liquid 310 pumped through holes 322 in bearing surface 321 of fluid bar 320 is only confined by first surface 251 of web of media 250. At first edge 253 and second edge 254 of web of media 250, deflected liquid 316 escapes at high velocity in an unconstrained manner. The same is also true for the deflected liquid 315 which is directed in upstream and downstream directions. Typically processing tank 330 has a lid (not shown) so that deflected liquid 315, 316 does not exit the processing tank 330, but as deflected liquid 315, 316 splashes off plating tank surfaces and lands in processing liquid 310, it can cause gas bubbles to be entrained throughout the processing tank 330.

Figure 7:
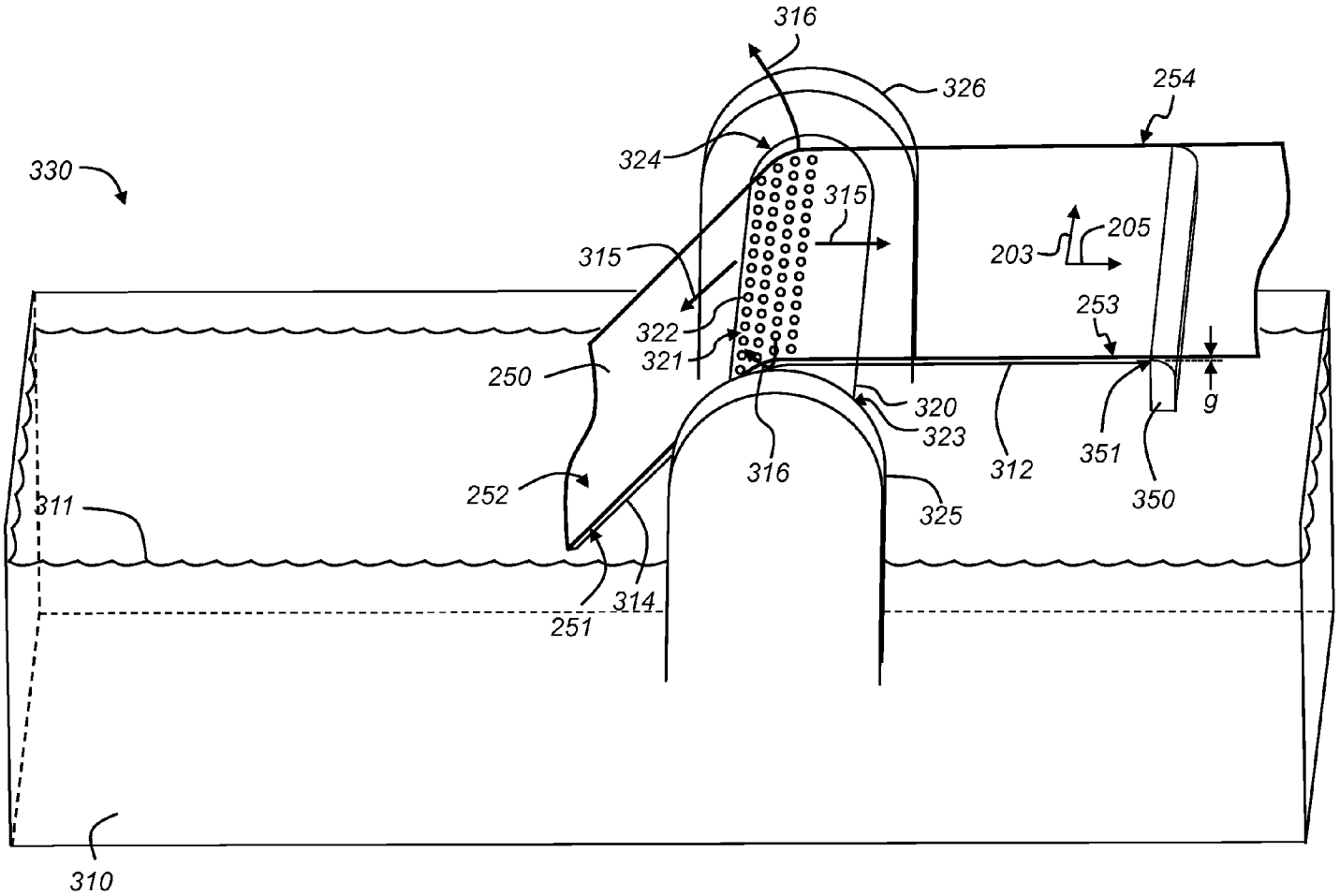
FIG. 7 shows a cutaway perspective of a plating tank including a scavenger blade positioned downstream of a non-submerged fluid bar.

FIG. 7 illustrates an exemplary configuration of the invention that includes a scavenger blade 350, which is disposed along the web-transport path downstream of the fluid bar 320 to prevent a large portion of the sheet of liquid 312 from exiting the processing tank 330. The scavenger blade 350 spans the web of media 250 in the cross-track direction 203 and includes a blade edge 351 that faces the first surface 251 of the web of media 250. The blade edge 351 is the portion of scavenger blade 350 that is closest to the first surface 251 of web of media 250. The blade edge 351 is spaced apart from the first surface 251 of the web of media 250 by a gap distance (g). In the illustrated configuration, the blade edge 351 comes to a sharpened point, but the blade edge 351 can be rounded in other configurations. The scavenger blade 350 does not touch web of media 250, but it is positioned at an appropriate gap distance so that it removes a significant portion of sheet of liquid 312 from the first surface 251 of web of media 250 as it passes by the scavenger blade 350, thereby reducing the amount of liquid that is carried along to portions of the web-transport path that are downstream of the scavenger blade 350.

Figure 8:
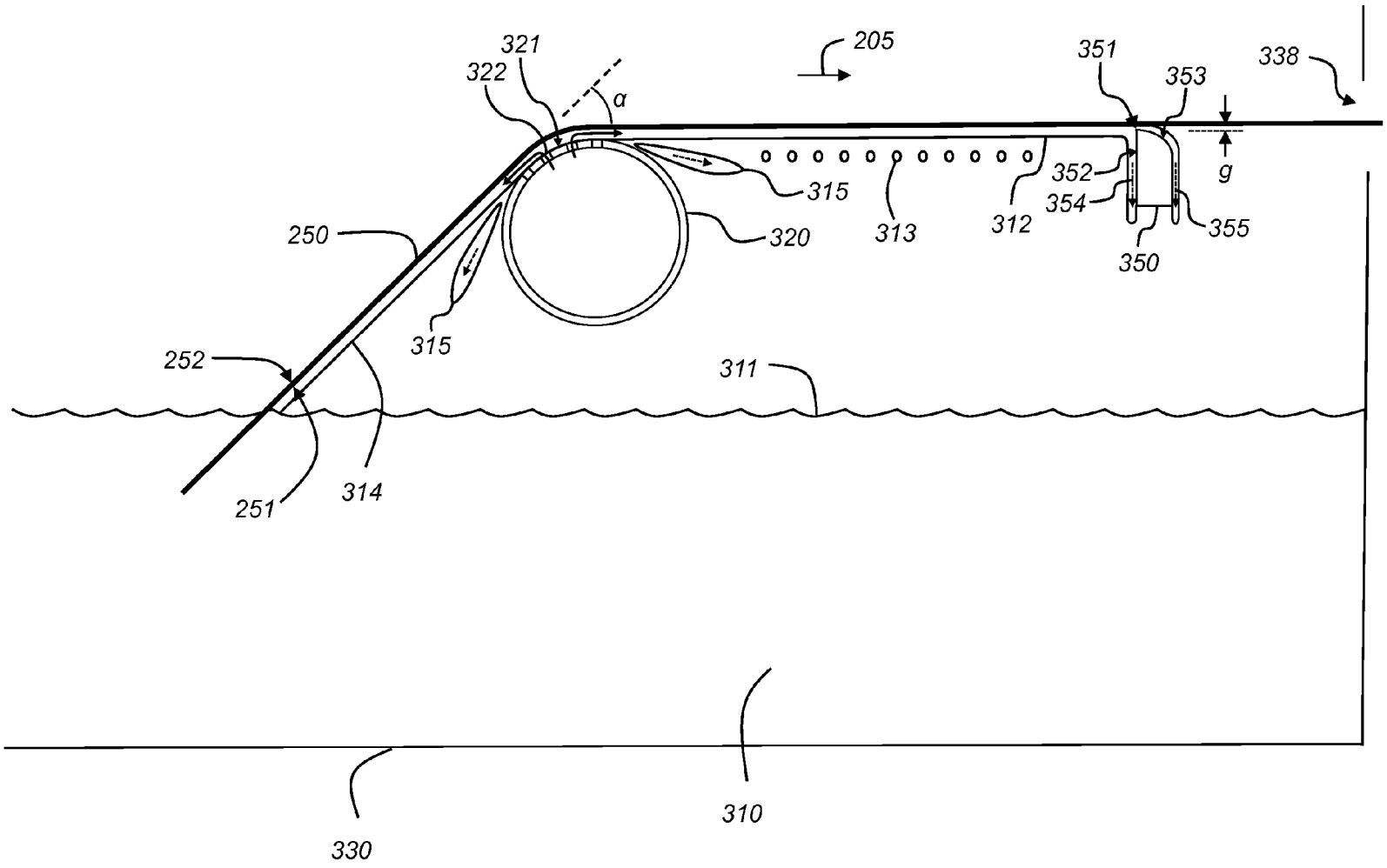
FIG. 8 shows a schematic side view of the plating tank of FIG. 7.

FIG. 8 is close-up schematic side view illustrating further details of the FIG. 7 configuration. The non-submerged fluid bar 320 ejects liquid (represented by the flow arrows) through the holes 322 in the bearing surface 321, which are above the liquid level 311. The fluid bar 320 supports the web of media 250 without touching it as web of media 250 is guided out of the processing liquid 310. As the web of media 250 passes the fluid bar 320, a direction of travel of the web of media 250 is redirected by an angle $\alpha$, which is typically at least 10 degrees. The angle $\alpha$ will correspond to the wrap angle of the web of media 250 around the fluid bar 320. In the example of FIG. 8, the web of media 250 is redirected so that it travels in a substantially horizontal direction (i.e., to within about ±5° of horizontal) as it passes scavenger blade 350.

In the illustration of FIG. 8, the fluid bar 320 is shown as having a cylindrical shape with a circular cross-section. However, in other cases the fluid bar can have other shapes. The bearing surface 321 will generally have a smoothly-varying profile, such as an arc of a circle or an ellipse. Other types of smoothly-varying profiles would include a curve corresponding to some other type of conic section or smoothly-varying function. Aside from the bearing surface 321 over which the web of media 250 rides, the other surfaces of the fluid bar 320 can have any shape (e.g., they can be flat surfaces).

In the example of FIGS. 7-8, the scavenger blade 350 is positioned downstream of the fluid bar 320 and below the web of media 250. The scavenger blade 350 includes a first surface 352 on one side of the blade edge 351 facing towards the fluid bar 320, and a second surface 353 on an opposite side of the blade edge 351 facing away from the fluid bar 320.

In the example of FIG. 8, the first surface 352 of the scavenger blade 350 is a substantially planar surface. Although only the straight edge of first surface 352 is shown in the side view of FIG. 8, the first surface 352 extends in the cross-track direction 203 (FIG. 7) in a substantially planar fashion. In other words, points along first surface 352 can be connected with each other by lines along the first surface 352 that are substantially straight (i.e., having a maximum deviation from straightness that is less than 1% of the width of the web of media 250 in the cross-track direction 203). In addition, in the example shown in FIG. 8, the first surface 352 of scavenger blade 350 is substantially perpendicular to the first surface 251 of the web of media 250. In other words, first surface 352 is perpendicular to first surface 251 within ±5 degrees.

The first surface 352 of the scavenger blade 350 diverts at least a portion of the liquid in sheet of liquid 312 being carried along by the web of media 250 away from the first surface 251 of the web of media 250 such that the portion of liquid flows down the first surface 352 of the scavenger blade 350 into the processing liquid 310 in the processing tank 330, as indicated by flow arrow 354.

Furthermore, in the example shown in FIG. 8, the second surface 353 of the scavenger blade 350 is a curved surface. As the remainder of the sheet of liquid 312 passes the scavenger blade 350, its momentum is significantly reduced. Second surface 353 of scavenger blade 350 draws at least portion of the liquid being carried along by the web of media 250 away from the first surface 251 of the web of media 250 as it passes over the blade edge 351 such that the portion of liquid flows down the second surface 353 of the scavenger blade into the processing liquid 310, as indicated by flow arrow 355. It has been found to be advantageous for the gap distance (g) between the blade edge 351 and the first surface 251 of the web of media 250 to be between 0.20 mm and 2.0 mm, and more preferably to be between 0.3 mm and 0.7 mm. The optimal gap distance can be affected by factors such as viscosity and surface tension of the processing liquid 310, as well as web speed and stability (e.g., amount of flutter) of the web profile as the web of media 250 passes the scavenger blade 350. It can also be advantageous for at least the portions of scavenger blade 350 near blade edge 351 to be more wettable by the liquid (e.g., the processing liquid 310) than first surface 251 of web of media 250. In this way, the liquid is attracted more strongly to the scavenger blade 350 than to the web of media 250, thereby causing a larger portion of the liquid to be drawn away from the web of media 250.

The scavenger blade 350 removes a large fraction of the sheet of liquid 312 from being carried along out of exit 338 of the processing tank 330 to downstream portions of the web-transport path. (As discussed earlier, the first surface 352 of scavenger blade 350 that is closest to the fluid bar 320 diverts a portion of the sheet of liquid 312 down the first surface 352 of the scavenger blade 350, and the second surface 353 draws a portion of the remaining liquid down the second surface 353 of the scavenger blade 350 and away from the first surface 251 of the web of media 250.) Furthermore, the scavenger blade 350 also serves to block any drips 313 of liquid, as well as any deflected liquid 315 that is sprayed out from the region between the first surface 251 of the web of media 250 and the bearing surface 321 of the fluid bar 320, from reaching the portions of the web-transport path that are beyond the scavenger blade 350.

The configuration illustrated in FIGS. 7-8 includes a scavenger blade 350 positioned downstream of the fluid bar 320 in order to prevent processing liquid 310 from being carried downstream by the web of media 250 outside processing tank 330, thereby preventing waste as well as contamination of the next tank. In other configurations, the scavenger blade 350 can be positioned upstream of the fluid bar 320 in order to block deflected liquid 315 from travelling upstream along the web-transport path to a place where it can cause waste or adversely impact the liquid processing of the web of media 250.

Figure 9:
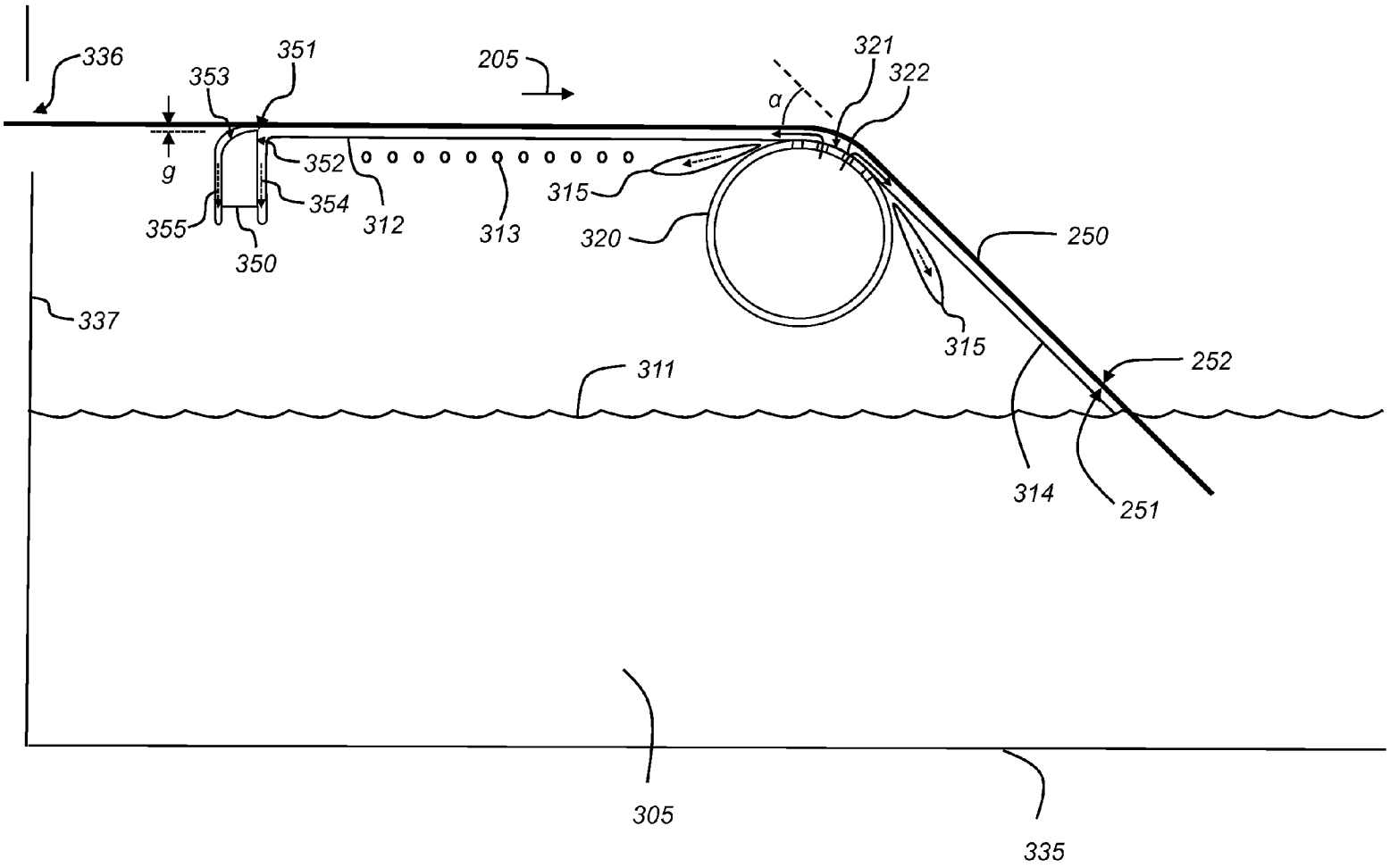
FIG. 9 shows a schematic side view of a plating tank with a scavenger blade positioned upstream of a non-submerged fluid bar.

An alternate configuration is shown in the schematic side view of FIG. 9 in which the non-submerged fluid bar 320 is positioned near the entrance of a processing tank 335, and the fluid bar 320 guides the web of media 250 from a substantially horizontal entry orientation to proceed into the processing liquid 305. For example, the tank can be processing tank 335 of FIG. 3, and the processing liquid 305 can be water. As the processing liquid 305 is ejected through the bearing surface 321 of the fluid bar 320, a sheet of liquid 314 is directed downstream along the web of media 250 and back into the reservoir of processing liquid 305. In other words sheet of liquid 314 does not travel to a place where it can cause waste or adversely impact the liquid processing of the web of media 250.

A second sheet of liquid 312 is directed upstream along the web of media 250 toward the entrance 336 of processing tank 335. Even though the web of media 250 is moving in the in-track direction 205, the velocity of sheet of liquid 312 in the opposite direction is much higher than the web velocity. Without having a scavenger blade 350 positioned near the entrance 336 of the processing tank 335, processing liquid 305 can spray over the entrance wall 337 of processing tank 335 and go through the entrance 336 into upstream portions of the processing path (e.g., into processing tank 330 of FIG. 3). This is undesirable, as it would cause the adverse effect of diluting the processing liquid 310. The scavenger blade 350 serves to reduce the amount of processing liquid 305 that travels to portions of the web-transport path that are upstream of the scavenger blade 350. Comparing FIGS. 8 and 9, it can be seen that the scavenger blade 350 in FIG. 9 is oriented in an opposite orientation from the scavenger blade 350 in FIG. 8. A guideline for the position and orientation of the scavenger blade 350 is that a) the scavenger blade 350 should be positioned downstream (in terms of web motion) of the fluid bar 320 if liquid directed by web of media 250 in the downstream direction would cause waste or adverse effects; b) the scavenger blade 350 should be positioned upstream (in terms of web motion) of fluid bar 320 if liquid directed by web of media 250 in the upstream direction would cause waste or adverse effects; and c) the orientation of the scavenger blade 350 should be such that the substantially planar first surface 352 faces toward the fluid bar 320 and the curved second surface 353 faces away from the fluid bar 320.

A fluid bar 320 and corresponding scavenger blade 350 located near the entrance 336 of a processing tank 335, as in the example of FIG. 9, can be referred to as an input fluid bar 320 and an input scavenger blade 350 respectively. A fluid bar 320 and corresponding scavenger blade 350 located near the exit 338 from a liquid processing tank 330, as in the example of FIG. 8 can be called an exit fluid bar 320 and an exit scavenger blade 350 respectively.

In some configurations, the arrangements of FIGS. 8 and 9 can be combined to keep liquid from escaping from a processing tank 330 in either the upstream or downstream directions. The arrangement of FIG. 9 with its input fluid bar 320 and input scavenger blade 350 can be used at the entrance to the processing tank 330, and the arrangement of FIG. 8 with its exit fluid bar 320 and exit scavenger blade 350 can be used at the exit from the same processing tank 330.

Elements of such a web transport system can be described as follows. An input fluid bar 320 (as in FIG. 9) is disposed along the web-transport path upstream of the position where the web of media 250 enters the processing liquid 310 (e.g., a plating solution) in the processing tank 330. The input fluid bar 320 redirects the web of media 250 toward the processing liquid as it passes the input fluid bar 320 with a first surface 251 of the web of media 250 facing an exterior bearing surface 321 of the input fluid bar 320. The processing liquid 310 is pumped through holes 322 in the bearing surface 321 of the input fluid bar 320 and into a region between the first surface 251 of the web of media 250 and the bearing surface 321 of the input fluid bar 320, thereby pushing the web of media 250 away from the input fluid bar 320. An input scavenger blade 350 is disposed along the web-transport path upstream of the input fluid bar 320 and spans the web of media 250 in a cross-track direction 203 (FIG. 7). The input scavenger blade 350 includes a blade edge 351 facing the first surface 251 of the web of media 250, the blade edge 351 being spaced apart from the first surface 251 of the web of media 250 by a gap distance. The input scavenger blade 350 removes at least some processing liquid 310 that flows out from the region between the first surface 251 of the web of media 250 and the bearing surface 321 of the input fluid bar 320, thereby preventing it from reaching portions of the web-transport path that are upstream of the input scavenger blade 350.

In addition, an exit fluid bar 320 (as in FIG. 8) is disposed along the web-transport path downstream of the position where the web of media 250 exits processing liquid 310 in the processing tank 330. (Note that the geometries of the entrance and exit fluid bars 320 may or may not be the same.) The exit fluid bar 320 redirects the web of media 250 as it passes the exit fluid bar 320 with the first surface 251 of the web of media 250 facing an exterior bearing surface 321 of the exit fluid bar 320. The processing liquid 310 is pumped through holes 322 in the bearing surface 321 of the exit fluid bar 320 and into a region between the first surface 251 of the web of media 250 and the bearing surface 321 of the exit fluid bar 320, thereby pushing the web of media 250 away from the exit fluid bar 320. An exit scavenger blade 350 is disposed along the web-transport path downstream of the exit fluid bar 320 and spans the web of media 250 in the cross-track direction 203. The exit scavenger blade 350 includes a blade edge 351 facing the first surface 251 of the web of media 250, the blade edge 351 being spaced apart from the first surface 251 of the web of media 250 by a gap distance. (Note that the shapes and gap distances may or may not be the same for the entrance and exit scavenger blades 350.) The exit scavenger blade removes at least some of the processing liquid 310 from the first surface 251 of the web of media 250 as it passes by the exit scavenger blade 350, thereby reducing the amount of processing liquid 310 that is carried along to portions of the web-transport path that are downstream of the exit scavenger blade 350.

Figure 10:
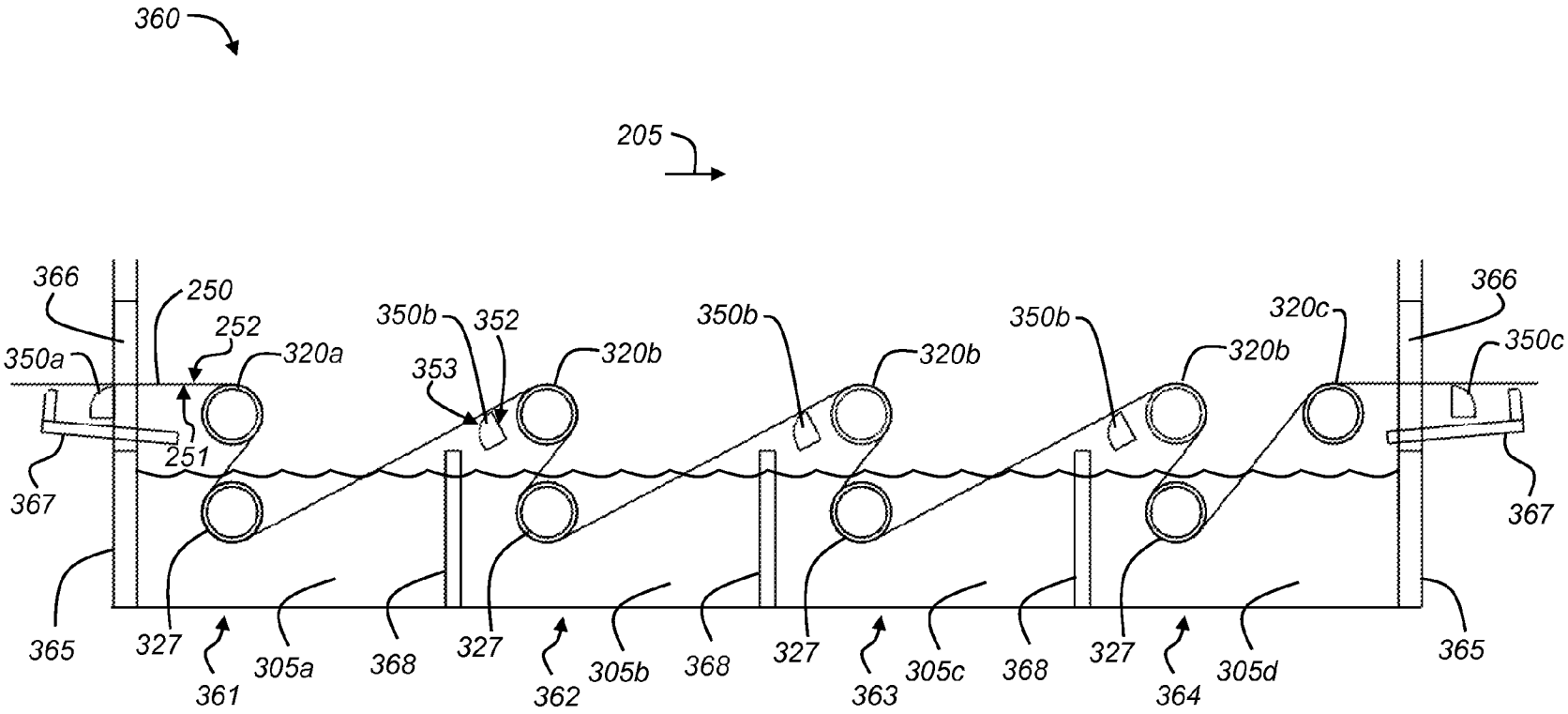
FIG. 10 shows a four-stage rinse tank with associated non-submerged fluid bars and scavenger blades.

In some configurations, non-submerged fluid bars 320, and corresponding scavenger blades 350, can also be positioned in intermediate positions along a web-transport path within a liquid processing tank, as for example in the schematic side view of a four-stage rinse tank 360 shown in FIG. 10. In some embodiments, the four-stage rinse tank 360 can follow a plating tank (e.g., processing tanks 330, 340 of FIG. 3). The four-stage rinse tank 360 includes first stage 361, second stage 362, third stage 363 and fourth stage 364, which are bounded by end walls 365 and partitions 368. The processing liquid 305*a*, 305*b*, 305*c*, 305*d* using in the four stages 361, 362, 363, 364 is typically water. However, other rinse solutions can also be used. As residues of plating solution, for example, are rinsed from web of media 250, processing liquid 305*a* in first stage 361 becomes most contaminated with residue, with the level of contamination being less for each successive stage 362, 363, 364. It is not desired for processing liquids 305*a*, 305*b*, 305*c*, 205*d* to be carried either upstream into the previous stage or downstream into the next stage.

The web of media 250 enters four-stage rinse tank 360 through an opening 366 in end wall 365 and moves along in-track direction 205. It is guided around non-submerged input fluid bar 320*a* to enter processing liquid 305*a*. Note that the processing liquid 305*a* ejected by input fluid bar 320*a* against first surface 251 of web of media 250 assists in the rinsing of first surface 251, and processing liquid 305*a* ejected by submerged fluid bar 327 against second surface 252 of web of media 250 assists in the rinsing of second surface 252 (and similarly for subsequent stages). After passing around submerged fluid bar 327, the web of media 250 is guided by non-submerged intermediate fluid bar 320*b* to exit the first stage 361 and enter processing liquid 305*b* of second stage 362. After passing around the submerged fluid bar 327 in the second stage 362, the web of media 250 is subsequently guided into processing liquid 305*c* of third stage 363 and processing liquid 305*d* of fourth stage 364. Finally, web of media 250 is guided out of the four-stage rinse tank 360 by non-submerged exit fluid bar 320*c* through opening 366 in end wall 365.

Scavenger blades 350*a*, 350*b*, 350*c* are associated with corresponding non-submerged fluid bars in order to reduce contamination between stages, as well as contamination flowing toward previous or subsequent portions of the processing path. Processing liquid 305*a* ejected from input fluid bar 320*a* flows both toward opening 366 in end wall 365 and also into the reservoir of processing liquid 305*a* in first stage 361. Processing liquid 305*a* flowing into the reservoir of processing liquid 305*a* is not a problem, but processing liquid 305*a* flowing toward opening 366 in end wall 365 can cause waste as well as contamination of a previous tank. Input scavenger blade 350*a* is positioned upstream of non-submerged input fluid bar 320*a* and oriented similar to the configuration of FIG. 9. In this case, the input scavenger blade 350*a* is positioned outside the end wall 365. An inclined tray 367 catches the processing liquid 305*a* that is removed by input scavenger blade 350*a* and guides it back into the reservoir of processing liquid 305*a* in first stage 361.

The configurations of non-submerged intermediate fluid bars 320*b* associated with second stage 362, third stage 363 and fourth stage 364 are similar to non-submerged input fluid bar 320*a*, such that liquid ejected toward the downstream direction of web of media 250 is directed back into the same stage that it came from. However, liquid ejected toward the upstream direction would tend to flow back into the previous stage without having intermediate scavenger blades 350*b* positioned upstream to block the liquid. In the example shown in FIG. 10, the web of media 250 is inclined upward toward the intermediate fluid bars 320*b*. The corresponding upstream intermediate scavenger blades 350*b* are oriented such that their planar first surfaces 352 are facing the associated intermediate fluid bars 320*b* with the first surfaces 352 being substantially perpendicular to the inclined web of media 250. Processing liquid 305*d* ejected from non-submerged exit fluid bar 320*c* in an upstream direction will flow back into the reservoir of processing liquid 305*d* in the fourth stage 364. However, processing liquid 305*d* ejected in a downstream direction would tend to be carried beyond the end wall 365. Exit scavenger blade 350*c* is positioned downstream of exit fluid bar 320*c* and oriented similar to the example of FIG. 8. In this case, the exit scavenger blade 350*c* is positioned outside the end wall 365. An inclined tray 367 catches the processing liquid 305*d* that is removed by exit scavenger blade 350*c* and guides it back into the reservoir of processing liquid 305*d* in the fourth stage 364.

Figure 11:
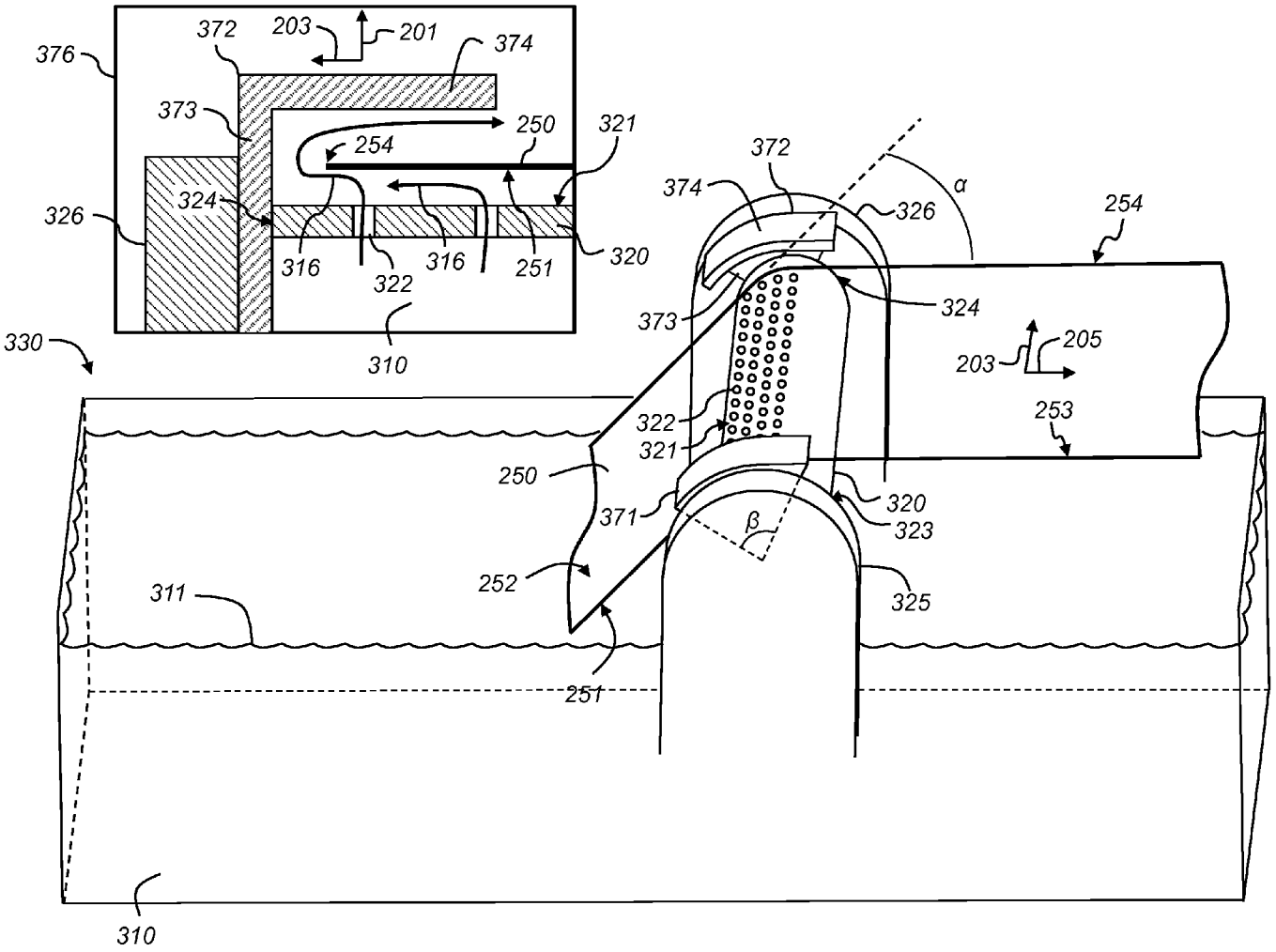
FIG. 11 shows fluid shields positioned at the ends of a non-submerged fluid bar.

As mentioned above with reference to FIG. 6, a second problem that can occur with non-submerged fluid bars 320 is that processing liquid 310 pumped through the holes 322 in the bearing surface 321 of the fluid bar 320 is only confined by the first surface 251 of web of media 250. At first edge 253 and second edge 254 of the web of media 250, deflected liquid 316 escapes at high velocity in an unconstrained manner and can spray in undesired directions. FIG. 11 shows a configuration of a processing tank 330 having a non-submerged fluid bar 320 that spans the width of the web of media 250 where a first fluid shield 371 and a second fluid shield 372 are positioned at the first end 323 and the second end 324 of the fluid bar 320, respectively. The first fluid shield 371 partially surround the first end 323 of the fluid bar 320 and the second fluid shield 372 partially surrounds the second end 324 of the fluid bar 320. The fluid shields 371, 372 are positioned to redirect the deflected liquid 316 (FIG. 6) that is ejected from the region between the first surface 251 of the web of media 250 and the bearing surface 321 of the fluid bar 320 along the first edge 253 and the second edge 254 of the web of media 250.

In the exemplary configuration of FIG. 11, the fluid shields 371, 372 include side walls 373 that are substantially perpendicular (i.e., within ±5° of perpendicular) to the cross-track direction 203 and are adapted to block deflected liquid 316 (FIG. 6) from flowing in the cross-track direction 203 beyond the first end 323 and the second end 324 of the fluid bar 320 respectively. In some embodiments, surfaces of the first mount 325 and the second mount 326 can perform the function of the side walls 373.

The fluid shields 371, 372 also include overhangs 374 that extend inward from the side walls 373 over the first and second edges 253, 254 of the web of media 250 respectively. Overhangs 374 block deflected liquid 316 (FIG. 6) from flowing outward away from the fluid bar 320 in a direction normal to the bearing surface 321 of the fluid bar 320. In an exemplary configuration, the contour of the overhangs 374 follows the contour of the bearing surface 321 such that a distance between the overhangs 374 of the fluid shields 371, 372 and the web of media 250 is substantially constant (i.e., to within about ±10%). Liquid (such as processing liquid 310) that is redirected by the fluid shields 371, 372 cascades back into the processing liquid 310 in the processing tank 330.

An inset 376 shows a cross-section of the fluid shield 372 at the second end 324 of the fluid bar 320 to illustrate the operation of the fluid shields 371, 372 in additional detail. As the processing liquid 310 is pumped through the holes 322 in the fluid bar 320 and lifts the first surface 251 of the web of media 250 away from the bearing surface 321 of the fluid bar 320, deflected fluid 316 is directed laterally in the cross-track direction 203 toward the second end 324 of the fluid bar 320. The side wall 373 of the fluid shield 372 is substantially perpendicular to the cross-track direction 203 and blocks the deflected fluid 316 from flowing in the cross-track direction 203 beyond the second end 324 of the fluid bar 320. The overhang 374 of the fluid shield 372 extends inward (in the cross-track direction 203) from the side wall 373 over the second edge 254 of the web of media 250 and blocks the deflected fluid 316 from flowing away from the fluid bar in a direction normal to the bearing surface 321 (i.e., normal direction 201).

The web of media 250 is wrapped around the fluid bar 320 for a wrap angle α, which is approximately 60 degrees in the example of FIG. 11, and is typically greater than about 10 degrees. The fluid shields 371, 372 preferably extend around the fluid bar 320 for an angle β (relative to the center of curvature of the arc-shaped bearing surface 321 of the fluid bar 320) that is at least as large as the wrap angle α. In the example of FIG. 11, β is approximately 90 degrees.

Another problem that can arise from the use of non-submerged fluid bars 320 is that the processing liquid 310 that is redirected by the scavenger blade 350 and the fluid shields 371, 372 can generate gas bubbles in the processing tank 330 as processing liquid 310 flows back into the processing tank 330. Gas bubbles can interfere with the liquid processing, especially for processes such as electroless plating on a web of media 250.

In the exemplary arrangement of FIG. 11, the fluid shields 371, 372 are shown as separate components that are affixed to the first mount 325 and the second mount 326, respectively. In other arrangements, the fluid shield 371 can be integrated into the first mount 325 so that they are a single part (e.g., using a molding or a milling process). Likewise, the fluid shield 372 can also be integrated into the second mount 326 so that they are a single part.

Figure 12:
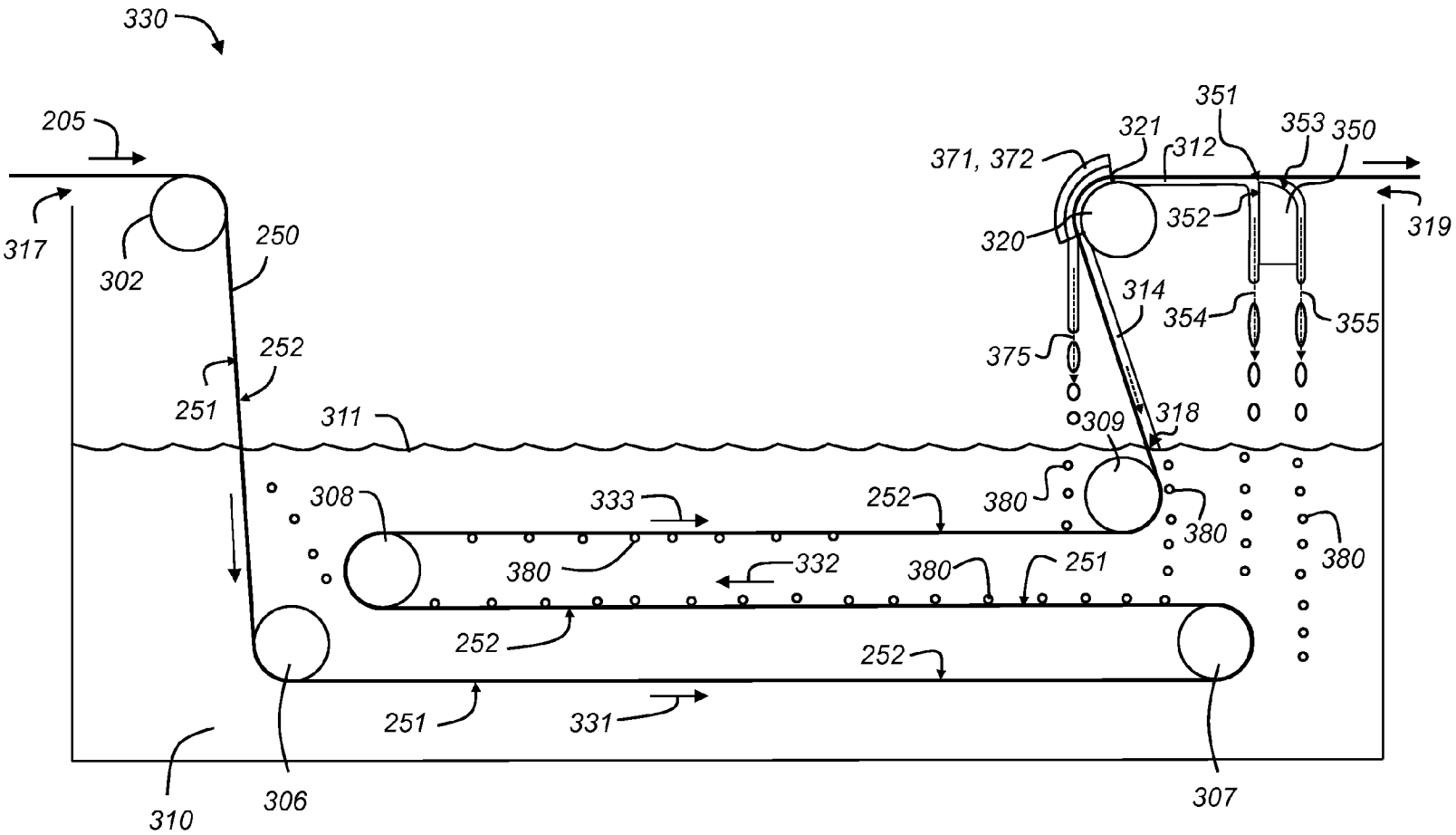
FIG. 12 shows a schematic side view of an electroless plating tank including a horizontal web.

FIG. 12 shows a schematic side view of a processing tank 330 where the web of media 250 enters through a tank entry 317 and is guided around a non-submerged web guide 302 and directed into the processing liquid 310.

The web of media 250 is then guided in a serpentine path by submerged web guides 306, 307, 308, 309. The web of media 250 travels in a substantially horizontal direction (i.e., within ±10° of horizontal) as it passes between the submerged web guides 306, 307, 308, 309. The final submerged web guide 309 redirects the web of media out of the processing liquid at a tank exit 318.

A non-submerged fluid bar 320 is positioned over the processing liquid 310 downstream of the tank exit 318. The non-submerged fluid bar 320 guides the web of media 250 toward a tank exit 319 of the processing tank 330. As described above, the web of media 250 passes around the fluid bar 320 with a first surface 251 of the web of media 250 facing an exterior bearing surface 321 of the fluid bar 320. Processing liquid 310 (generally extracted from the processing tank 330) is pumped through holes 322 (FIG. 7) in the bearing surface 321 of the fluid bar 320 and into a region between the first surface 251 of the web of media 250 and the bearing surface 321 of the fluid bar 320, thereby pushing the web of media 250 away from the fluid bar 320.

A scavenger blade 350 and fluid shields 371, 372 are provided for redirecting the processing liquid 310 ejected from fluid bar 320 back into the reservoir of processing liquid 310 in the processing tank 330. The downward flows of redirected liquid down first surface 352 and second surface 353 of scavenger blade 350 are indicated by flow arrows 354 and 355 respectively. The downward flow of redirected liquid from fluid shields 371, 372 is indicated by flow arrow 375. Thus, the processing liquid 310 that is pumped through the fluid bar 320 is returned to the processing tank 330 by flowing downward from the fluid bar 320. What is meant broadly herein by flowing downward from the fluid bar 320 includes downward flows from scavenger blade 350 (e.g., the flows indicated by flow arrows 354, 355), as well as downward flow from the fluid shields 371, 372 (e.g., the flow indicated by flow arrow 375) and sheet of liquid 314. The flow is generally not in an entirely vertical direction, but will be in an overall downward direction as gravity causes it to fall back into the reservoir of processing liquid 310 in the processing tank 330.

The processing liquid 310 that flows back into the reservoir does not cause contamination of processing liquid 310 in the processing tank 330, but it can generate gas bubbles 380 in the processing liquid 310. The redirected liquid can entrain air so that when it splashes into the reservoir of processing liquid 310 in processing tank 330, gas bubbles 380 (i.e., air bubbles) are generated. As a result the returned processing liquid 310 includes entrained gas bubbles 380. The redirected splashing processing liquid 310 is an example of a gas bubble source by which gas bubbles 380 are introduced into the processing liquid 310 in the processing tank 330.

Gas bubbles 380 are not a problem if they are kept away from web of media 250 during the electroless plating operation. Due to their buoyancy, such benign gas bubbles 380 float to the surface of the processing liquid 310 at liquid level 311 and exit the processing liquid 310 without contacting the web of media 250. However, if gas bubbles 380 attach themselves to web of media 250, for example to an underside of the web of media 250, they can cause non-uniformities and voids in the plating. A substantially horizontal serpentine web path, as shown in the example of FIG. 12, is particularly susceptible to spreading gas bubbles 380 throughout the processing tank 330 and onto one or both surfaces 251, 252 of the web of media 250. In the illustrated example, the immersed web of media 250 travels along a first horizontal segment (also called a leg herein) from submerged web guide 306 to submerged web guide 307 in first leg direction 331 (which is substantially in the same direction as in-track direction from tank entry 317 toward tank exit 319). The web direction is then reversed at submerged web guide 307 such that the web of media 250 travels along a second leg from submerged web guide 307 to submerged web guide 308 in second leg direction 332 (which is substantially in the opposite direction as the in-track direction 205). The web direction is again reversed at submerged web guide 308 such that web of media 250 travels along a third leg from submerged web guide 308 to submerged web guide 309 in third leg direction 333 (which again is substantially in the same direction as in-track direction 205).

Gas bubbles 380 which were generated by the splashing liquid flowing downward along flow arrows 354, 355 and along the sheet of liquid 314 can attach themselves, for example, to the first surface 251 of the web of media 250 just to the left of submerged web guide 307 and then be carried by the web of media 250 in second leg direction 332. As the web of media 250 travels along the second leg of the horizontal serpentine web path, some gas bubbles 380 can detach and float upward to attach to first surface 251 of the web of media 250 along the third leg of the serpentine web path. Other gas bubbles 380 can be dislodged at submerged web guide 308 and either float to the surface or become attached to second surface 252 of web of media 250 upstream of submerged web guide 306. Similarly, gas bubbles 380 which were generated by splashing liquid flowing downward along flow arrow 375 can attach themselves, for example to the second surface 252 of the web of media 250 just to the left of submerged web guide 309.

Figure 13:
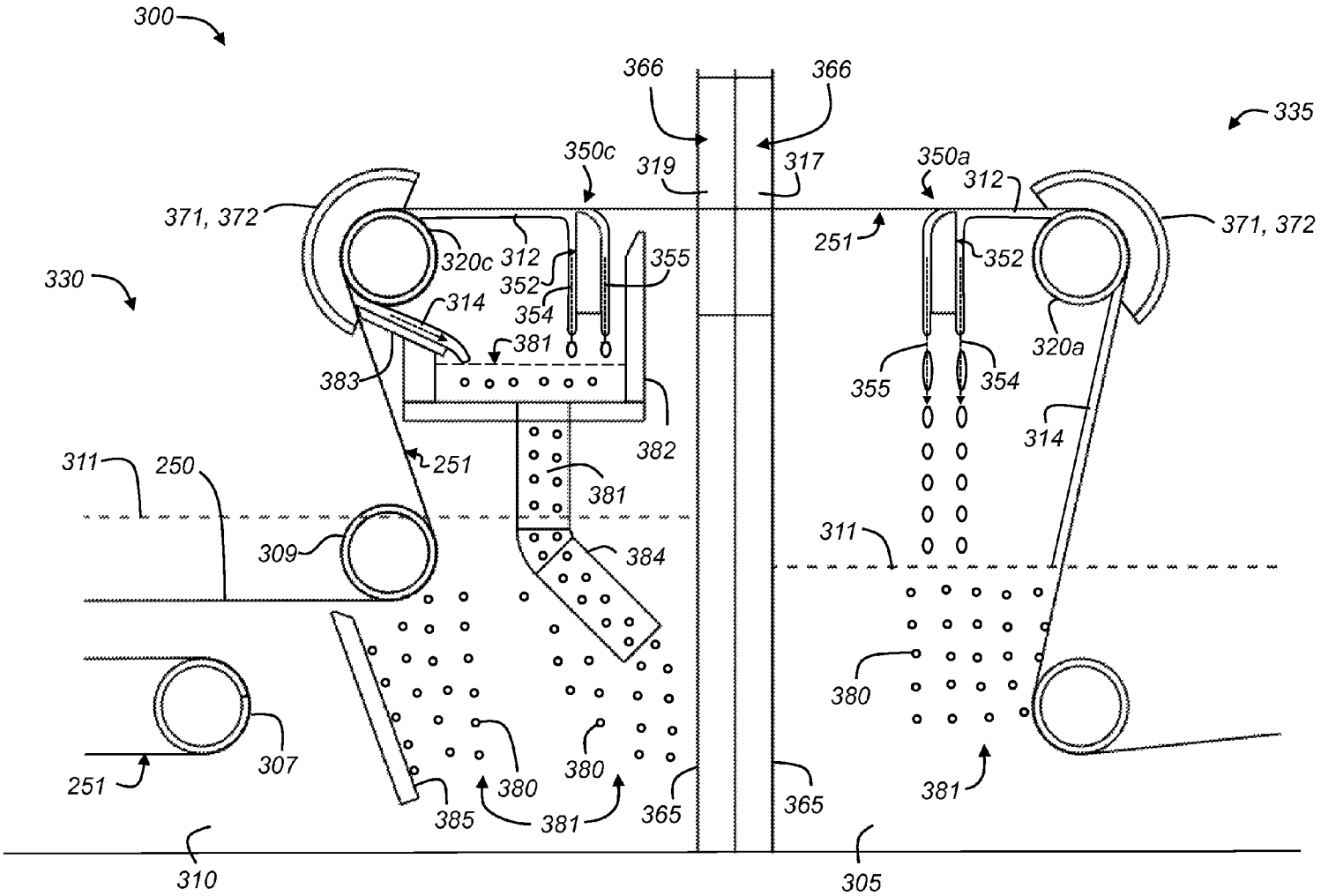
FIG. 13 shows a schematic side view of web transport from a plating tank to a rinse tank and fluid guides to keep bubbles away from the web.

FIG. 13 shows a schematic side view of a portion of a roll-to-roll liquid processing system 300 where a web of media 250 is transported from a first processing tank 330 to a second processing tank 335. With reference also to FIG. 12, the web of media 250 is guided the processing tank 330 in a horizontal serpentine web path through processing liquid 310 (e.g., a plating solution) by submerged web guides including submerged web guides 307, 309. The web of media 250 is then guided around non-submerged exit fluid bar 320*c* past exit scavenger blade 350*c* through openings 366 in end walls 365 of the processing tanks 330, 335.

The web of media 250 is then guided past input scavenger blade 350*a* and around non-submerged input fluid bar 320*a* into processing liquid 305 (e.g., a rinsing liquid such as water). In the configuration of FIG. 13, bubble-containing processing liquid 381 containing gas bubbles 380 that are formed in the processing liquid 310 by the downward flows from the input scavenger blade 350*a* (e.g., the flows indicated by flow arrows 354, 355) and the sheets of liquid 312, 314 are redirected away from web of media 250 by one or more fluid guides in processing tank 330, so that they are substantially prevented from being carried along by the web of media 250 toward the plating tank entry 317 (as discussed relative to FIG. 12). Within the context of the present invention, "substantially prevented from being carried along by the web of media 250" means that fewer than 10% of the gas bubbles 380 are carried along by the web of media 250.

The illustrated configuration uses a number of different fluid guides to direct the bubble-containing processing liquid 381, including catch tray 382, inclined lip 383, channel 384 and barrier 385. The catch tray 382 collects bubble-containing processing liquid 381 from sheet of liquid 314 and downward flows from the exit scavenger blade 350*c* (e.g., the flows indicated by flow arrows 354, 355). An inclined lip 383 extends from catch tray 382 toward first surface 251 of web of media 250 just upstream of the non-submerged exit fluid bar 350*c* to divert a substantial portion of the sheet of liquid 314 into the catch tray 382. A channel 384 extends from the bottom of the catch tray 382 and directs the bubble-containing processing liquid 381 back into the reservoir of processing liquid 310 in a region of the processing tank 330 away from the serpentine web-transport path (i.e., away from the submerged web guides 307, 309). Gas bubbles 380 in this region can float to the surface of the processing liquid 310 without encountering the web of media 250. Barrier 385 provides further protection to block gas bubbles 380 from being carried into the serpentine web-transport path. In this exemplary configuration, the barrier 385 is positioned between the location where the channel 384 directs the bubble-containing processing liquid 381 back into the processing tank 330 and the horizontal serpentine web path through the processing tank 330.

Although gas bubbles 380 are also generated by sheet of liquid 314 and downward flows from the scavenger blade 350*a* (e.g., the flows indicated by flow arrows 354, 355) in the second processing tank 335, the processing liquid 305 in processing tank 335 in this example is water. Therefore in this example, gas bubbles 380 in processing tank 335 do not interfere substantially with the rinse process. Accordingly, it is unnecessary to provide fluid guides in the second processing tank 335 to redirect the bubble-containing processing liquid 381.

The portion of the roll-to-roll liquid processing system 300 in FIG. 13 is useful for processing a web of media 250 along a web-transport path through a first liquid processing tank (processing tank 330) and subsequently through a second liquid processing tank (processing tank 335) that is adjacent to and downstream of the first liquid processing tank. A non-submerged exit fluid bar 320*c* in processing tank 330 is upstream of and near the tank exit 319 of processing tank 330. An exit scavenger blade 350*c*, having a first orientation with planar first surface 352 facing upstream, is downstream of the non-submerged exit fluid bar 320*c*. A non-submerged input fluid bar 320*a* in processing tank 335 is downstream of and near the tank entry 317 of processing tank 335. An input scavenger blade 350*a*, having a second orientation with planar face 352 facing downstream (which is opposite the first orientation) is upstream of the non-submerged exit fluid bar 320*c*.

Commonly-assigned, co-pending U.S. patent application Ser. No. 14/455,196, entitled "Roll-to-roll electroless plating system with low dissolved oxygen content," by G. Wainwright et al., which is incorporated herein by reference, describes various arrangements for controlling the amount of oxygen in a plating solution for an electroless plating system. The disclosed configurations involve injecting bubbles of an inert gas into the plating solution. If these gas bubbles come in contact with the web of media, they can result in the formation of artifacts as described earlier. Related inventions are described in commonly-assigned, co-pending U.S. patent application Ser. No. 14/455,227, entitled "Method for roll-to-roll electroless plating with low dissolved oxygen content" by G. Wainwright et al., and commonly-assigned, co-pending U.S. patent application Ser. No. 14/455,246, entitled "Roll-to-roll electroless plating system with micro-bubble injector" by G. Wainwright et al., both of which are incorporated herein by reference.

Figure 14:
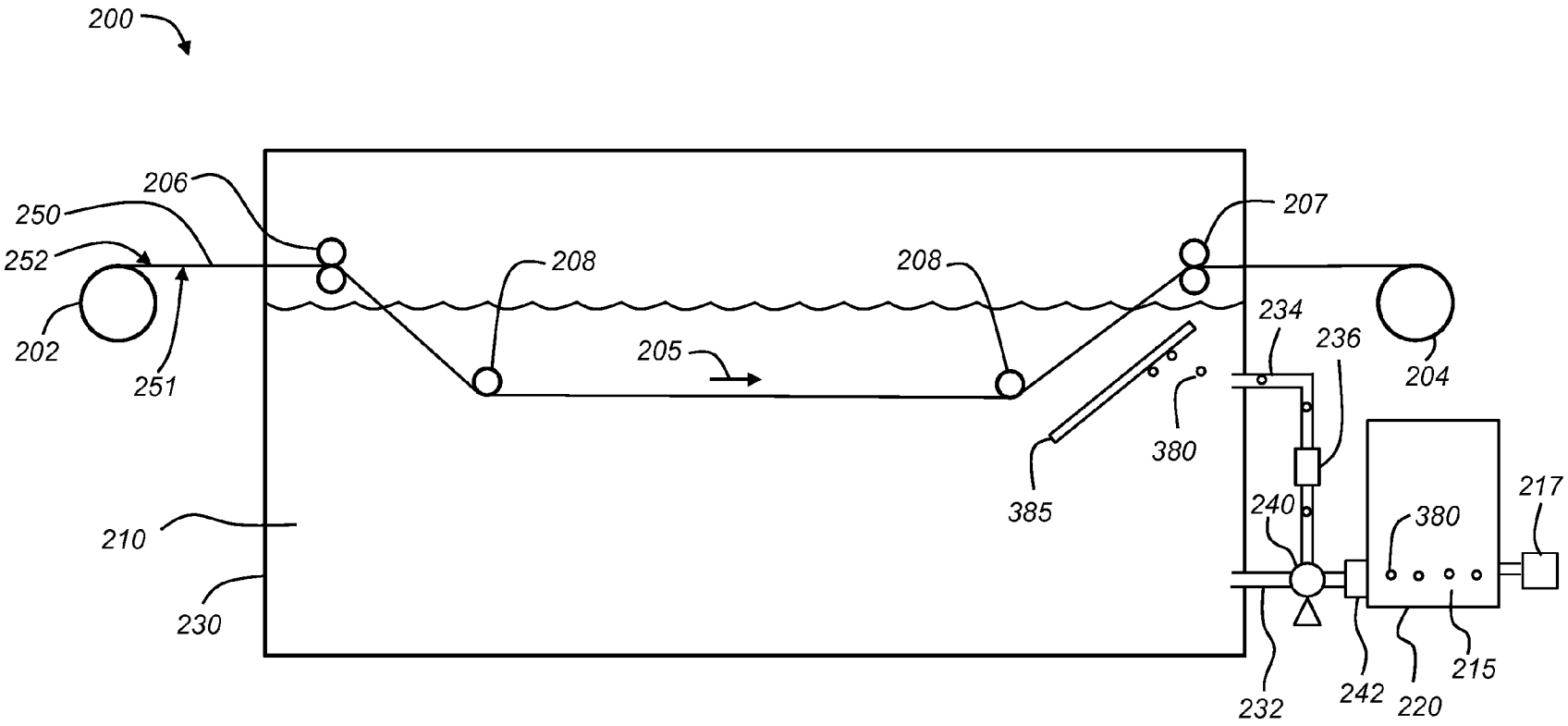
FIG. 14 shows a solvent replenishment system that injects gas bubbles into a plating tank.

FIG. 14 is similar to FIG. 2 discussed above having a plating solution replenishment system that includes a drain pipe 232, a pump 240, a plating solution reservoir 220 and a return pipe 234, but also contains additional elements. Plating solution 210 is drawn out of the plating tank 230 through drain pipe 232. One or more substances are added to the plating solution 210 to provide replenished plating solution 215 in reservoir 220, and the replenished plating solution is returned to the plating tank 230 through return pipe 234. In the example shown in FIG. 14, gas bubbles 380 (which may be nitrogen or oxygen for example) are injected by gas injector 217 into the reservoir 220 and then pass into plating solution 210 in tank 230 through return pipe 234, so that replenished plating solution 215 includes entrained gas bubbles 380. In this example, replenished plating solution 215 is a gas bubble source by which gas bubbles 380 are introduced into the plating solution 210. A barrier 385 acts as a fluid guide to keep the injected gas bubbles 380 away from the web of media 250, thereby preventing the formation of artifacts during the plating process.

Figure 15:
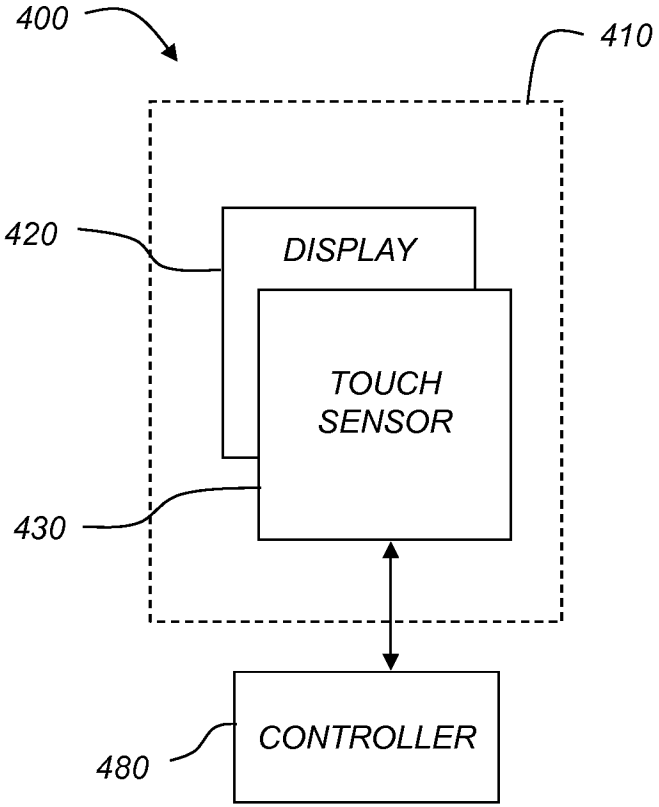
FIG. 15 is a high-level system diagram for an apparatus having a touch screen with a touch sensor that can be printed using embodiments of the invention.

FIG. 15 shows a high-level system diagram for an apparatus 400 having a touch screen 410 including a display device 420 and a touch sensor 430 that overlays at least a portion of a viewable area of display device 420. Touch sensor 430 senses touch and conveys electrical signals (related to capacitance values for example) corresponding to the sensed touch to a controller 480. Touch sensor 430 is an example of an article that can be printed on one or both sides by the flexographic printing system 100 and plated using an embodiment of roll-to-roll liquid processing system 300 where the web of media 250 is guided by non-submerged fluid bars associated with corresponding scavenger blades, fluid shields and fluid barriers as described above.

Figure 16:
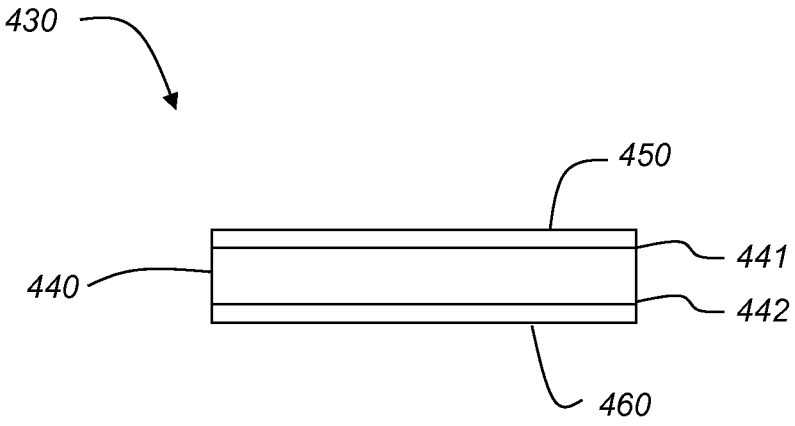
FIG. 16 is a side view of the touch sensor of FIG. 15.

FIG. 16 shows a schematic side view of a touch sensor 430. Transparent substrate 440, for example polyethylene terephthalate, has a first conductive pattern 450 printed and plated on a first side 441, and a second conductive pattern 460 printed and plated on a second side 442. The length and width of the transparent substrate 440, which is cut from the take-up roll 104 (FIG. 1), is not larger than the flexographic printing plates 112, 122, 132, 142 of flexographic printing system 100 (FIG. 1), but it could be smaller than the flexographic printing plates 112, 122, 132, 142.

Figure 17:
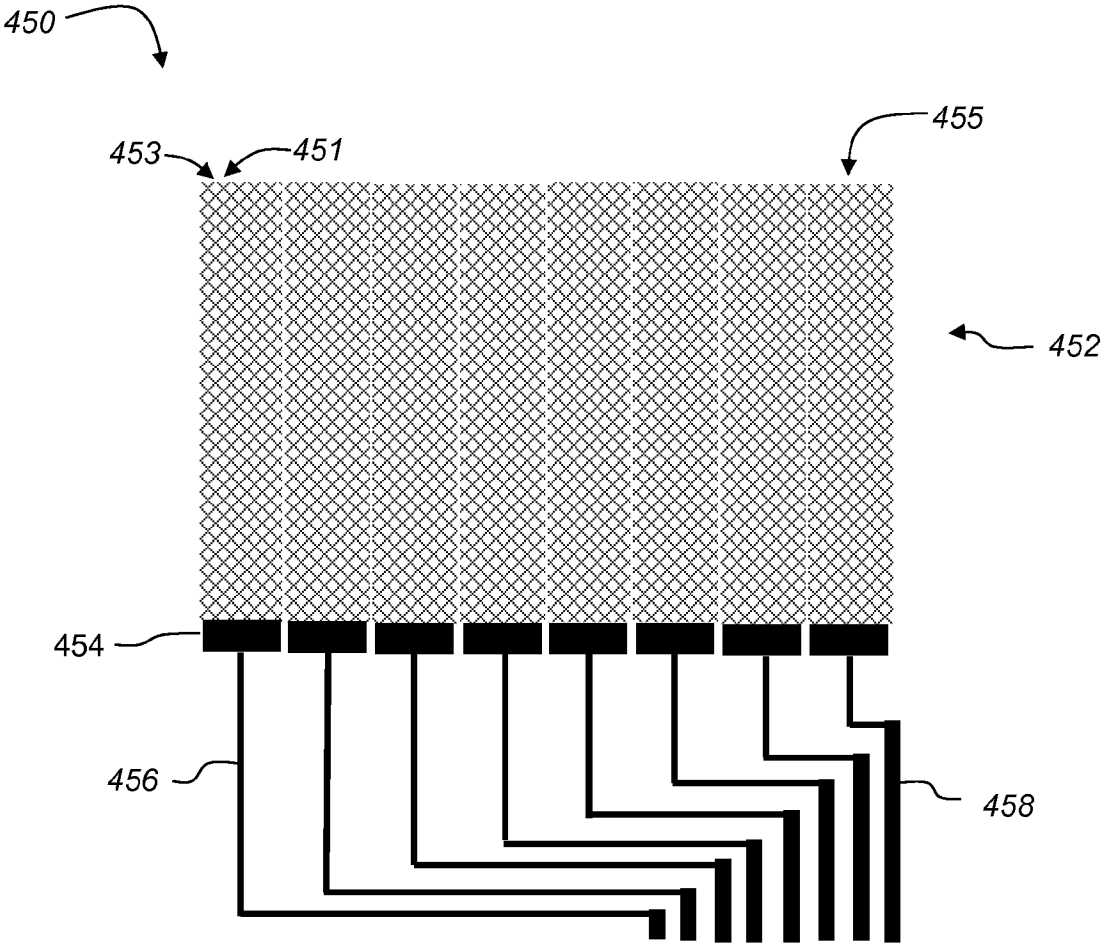
FIG. 17 is a top view of a conductive pattern printed on a first side of the touch sensor of FIG. 16.

FIG. 17 shows an example of a conductive pattern 450 that can be printed on first side 441 (FIG. 16) of substrate 440 (FIG. 16) using one or more print modules such as print modules 120 and 140 of flexographic printing system (FIG. 1), followed by plating using an embodiment of roll-to-roll liquid processing system 300 (FIG. 3). Conductive pattern 450 includes a grid 452 including grid columns 455 of intersecting fine lines 451 and 453 that are connected to an array of channel pads 454. Interconnect lines 456 connect the channel pads 454 to the connector pads 458 that are connected to controller 480 (FIG. 15). Conductive pattern 450 can be printed by a single print module 120 in some embodiments. However, because the optimal print conditions for fine lines 451 and 453 (e.g., having line widths on the order of 4 to 8 microns) are typically different than for printing the wider channel pads 454, connector pads 458 and interconnect lines 456, it can be advantageous to use one print module 120 for printing the fine lines 451 and 453 and a second print module 140 for printing the wider features. Furthermore, for clean intersections of fine lines 451 and 453, it can be further advantageous to print and cure one set of fine lines 451 using one print module 120, and to print and cure the second set of fine lines 453 using a second print module 140, and to print the wider features using a third print module (not shown in FIG. 1) configured similarly to print modules 120 and 140.

Figure 18:
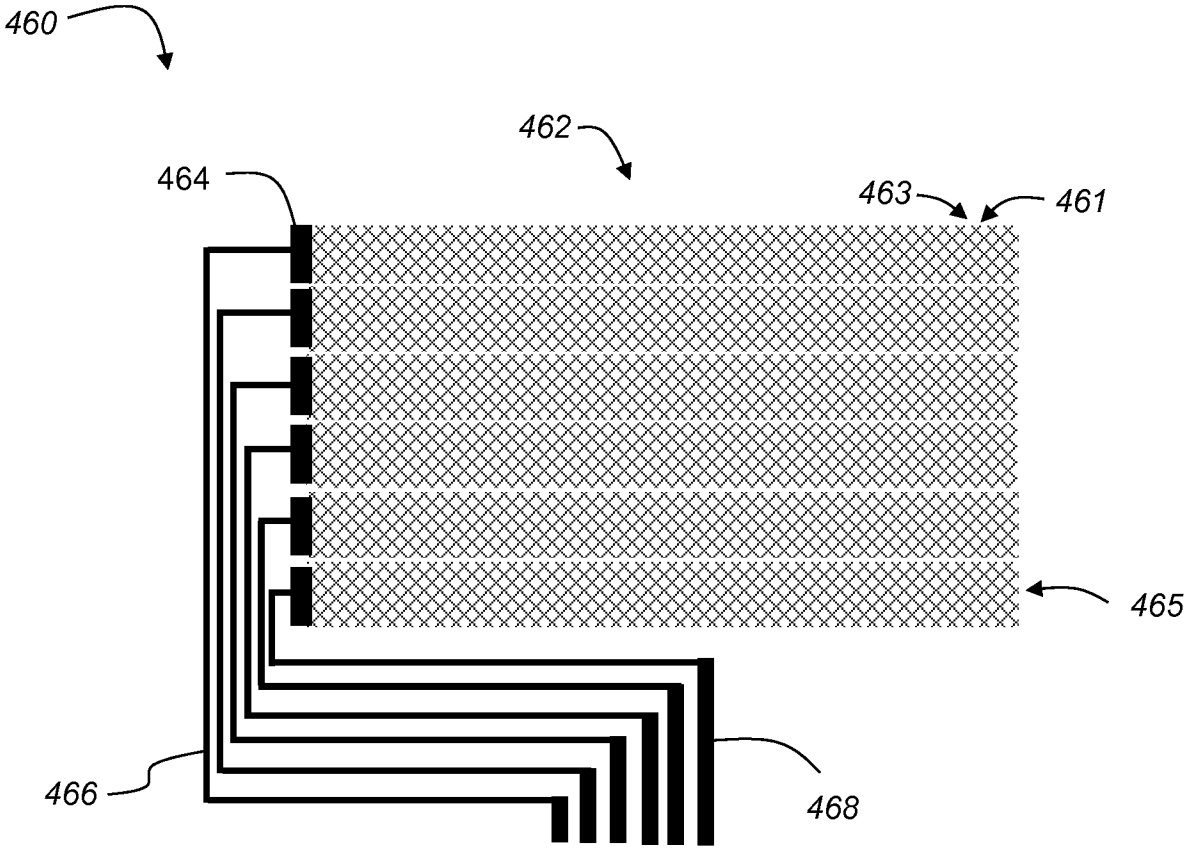
FIG. 18 is a top view of a conductive pattern printed on a second side of the touch sensor of FIG. 16.

FIG. 18 shows an example of a conductive pattern 460 that can be printed on second side 442 (FIG. 16) of substrate 440 (FIG. 16) using one or more print modules such as print modules 110 and 130 of flexographic printing system (FIG. 1), followed by plating using an embodiment of roll-to-roll liquid processing system 300 (FIG. 3). Conductive pattern 460 includes a grid 462 including grid rows 465 of intersecting fine lines 461 and 463 that are connected to an array of channel pads 464. Interconnect lines 466 connect the channel pads 464 to the connector pads 468 that are connected to controller 480 (FIG. 15). In some embodiments, conductive pattern 460 can be printed by a single print module 110. However, because the optimal print conditions for fine lines 461 and 463 (e.g., having line widths on the order of 4 to 8 microns) are typically different than for the wider channel pads 464, connector pads 468 and interconnect lines 466, it can be advantageous to use one print module 110 for printing the fine lines 461 and 463 and a second print module 130 for printing the wider features. Furthermore, for clean intersections of fine lines 461 and 463, it can be further advantageous to print and cure one set of fine lines 461 using one print module 110, and to print and cure the second set of fine lines 463 using a second print module 130, and to print the wider features using a third print module (not shown in FIG. 1) configured similarly to print modules 110 and 130.

Alternatively, in some embodiments conductive pattern 450 can be printed using one or more print modules configured like print modules 110 and 130, and conductive pattern 460 can be printed using one or more print modules configured like print modules 120 and 140 of FIG. 1 followed by plating using an embodiment of roll-to-roll liquid processing system 300 (FIG. 3).

With reference to FIGS. 15-18, in operation of touch screen 410, controller 480 can sequentially electrically drive grid columns 455 via connector pads 458 and can sequentially sense electrical signals on grid rows 465 via connector pads 468. In other embodiments, the driving and sensing roles of the grid columns 455 and the grid rows 465 can be reversed.

The invention has been described in detail with particular reference to certain preferred embodiments thereof, but it will be understood that variations and modifications can be effected within the spirit and scope of the invention.

PARTS LIST

100 flexographic printing system
102 supply roll
104 take-up roll
105 roll-to-roll direction
106 roller
107 roller
110 print module
111 plate cylinder
112 flexographic printing plate
113 raised features
114 impression cylinder
115 anilox roller
116 UV curing station
120 print module
121 plate cylinder
122 flexographic printing plate
124 impression cylinder
125 anilox roller
126 UV curing station
130 print module
131 plate cylinder
132 flexographic printing plate
134 impression cylinder
135 anilox roller
136 UV curing station
140 print module
141 plate cylinder
142 flexographic printing plate
144 impression cylinder
145 anilox roller
146 UV curing station
150 substrate
151 first side
152 second side
200 roll-to-roll electroless plating system
201 normal direction
202 supply roll
203 cross-track direction
204 take-up roll
205 in-track direction
206 drive roller
207 drive roller
208 web-guiding roller
210 plating solution
215 replenished plating solution
217 gas injector

220 reservoir
230 tank
232 drain pipe
234 return pipe
236 filter
240 pump
242 controller
250 web of media
251 first surface
252 second surface
253 first edge
254 second edge
300 roll-to-roll liquid processing system
302 non-submerged web guide
304 submerged web guide
305 processing liquid
305*a* processing liquid
305*b* processing liquid
305*c* processing liquid
305*d* processing liquid
306 submerged web guide
307 submerged web guide
308 submerged web guide
309 submerged web guide
310 processing liquid
311 liquid level
312 sheet of liquid
313 drips
314 sheet of liquid
315 deflected liquid
316 deflected liquid
317 tank entry
318 liquid exit position
319 tank exit
320 fluid bar
320*a* input fluid bar
320*b* intermediate fluid bar
320*c* exit fluid bar
321 bearing surface
322 holes
323 first end
324 second end
325 first mount
326 second mount
327 fluid bar
330 processing tank
331 first leg direction
332 second leg direction
333 third leg direction
335 processing tank
336 entrance
337 entrance wall
338 exit
340 processing tank
345 processing tank
350 scavenger blade
350*a* input scavenger blade
350*b* intermediate scavenger blade
350*c* exit scavenger blade
351 blade edge
352 first surface
353 second surface
354 flow arrow
355 flow arrow
360 four-stage rinse tank
361 first stage
362 second stage
363 third stage
364 fourth stage
365 end wall
366 opening
367 inclined tray
368 partition
371 fluid shield
372 fluid shield
373 side wall
374 overhang
375 flow arrow
376 inset
380 gas bubble
381 bubble-containing processing liquid
382 catch tray
383 inclined lip
384 channel
385 barrier
390 inset
400 apparatus
410 touch screen
420 display device
430 touch sensor
440 transparent substrate
441 first side
442 second side
450 conductive pattern
451 fine lines
452 grid
453 fine lines
454 channel pads
455 grid column
456 interconnect lines
458 connector pads
460 conductive pattern
461 fine lines
462 grid
463 fine lines
464 channel pads
465 grid row
466 interconnect lines
468 connector pads
480 controller
g gap distance
$\alpha$ angle
$\beta$ angle

The invention claimed is:

1. A web transport system for transporting a web of media along a web-transport path, comprising:

a fluid bar disposed along the web-transport path, the web of media being guided as it passes the fluid bar with a first surface of the web of media facing an exterior bearing surface of the fluid bar, wherein a liquid is pumped through holes in the bearing surface of the fluid bar and into a region between the first surface of the web of media and the bearing surface of the fluid bar, thereby pushing the web of media away from the fluid bar, and wherein the fluid bar is not submerged in a liquid; and a scavenger blade disposed along the web-transport path downstream of the fluid bar, the scavenger blade spanning the web of media in a cross-track direction and including a sharp blade edge facing the first surface of the web of media, the sharp blade edge being spaced apart from the first surface of the web of media by a gap distance of at least 0.20 mm, wherein the web of media does not contact the scavenger blade and the web of media is not redirected as it passes by the scavenger blade, and wherein the scavenger blade removes at least some liquid from the first surface of the web of media as it passes by the scavenger blade, thereby reducing the amount of liquid that is carried along to portions of the web-transport path that are downstream of the scavenger blade;

wherein the scavenger blade includes a first surface on one side of the blade edge facing towards the fluid bar and a second surface on an opposite side of the blade edge facing away from the fluid bar, wherein the first surface of the scavenger blade is a substantially planar surface and the second surface of the scavenger blade is a curved surface, wherein the first and second surfaces meet to form the sharp blade edge along a leading edge of the scavenger blade, and wherein the scavenger blade draws away at least a portion of the liquid being carried along by the web of media from the first surface of the web of media as it passes over the blade edge such that at least some of the drawn away portion of the liquid flows down the second surface of the scavenger blade.

2. The web transport system of claim 1, wherein the first surface of the scavenger blade is substantially perpendicular to the first surface of the web of media.

3. The web transport system of claim 1, wherein the scavenger blade diverts at least a portion of the liquid being carried along by the web of media away from the first surface of the web of media such that the diverted portion of the liquid flows down the first surface of the scavenger blade.

4. The web transport system of claim 1, wherein the gap distance is between 0.20 mm and 2.0 mm.

5. The web transport system of claim 1, wherein the scavenger blade blocks fluid that is sprayed out from the region between the first surface of the web of media and the bearing surface of the fluid bar from reaching the portions of the web-transport path that are downstream of the scavenger blade.

6. The web transport system of claim 1, wherein the web-transport path advances the web of media through a tank of the liquid upstream of the fluid bar.

7. The web transport system of claim 6, wherein the liquid removed from the first surface of the web of media is directed into the tank of the liquid.

8. The web transport system of claim 6, wherein the liquid is a plating solution for an electroless plating process, and wherein a plating substance in the plating solution is plated onto predetermined locations on the web of media as it is advanced through the plating solution in the tank of liquid.

9. The web transport system of claim 1, wherein the web of media is travelling in a substantially horizontal direction as it passes by the scavenger blade.

10. The web transport system of claim 9, wherein the scavenger blade is positioned below the web of media.

11. The web transport system of claim 1, wherein a direction of travel of the web of media is redirected by more than 10 degrees as it passes the fluid bar.

12. The web transport system of claim 1, wherein the bearing surface of the fluid bar has an arc-shaped cross-section.

13. The web transport system of claim 1, wherein at least a portion of the scavenger blade proximate the blade edge is more wettable than the first surface of the web of media such that the liquid is attracted more strongly to the scavenger blade than to the first surface of the web of media.

14. A web transport system for transporting a web of media along a web-transport path, comprising:

a fluid bar disposed along the web-transport path, the web of media being guided as it passes the fluid bar with a first surface of the web of media facing an exterior bearing surface of the fluid bar, wherein a liquid is pumped through holes in the bearing surface of the fluid bar and into a region between the first surface of the web of media and the bearing surface of the fluid bar, thereby pushing the web of media away from the fluid bar, and wherein the fluid bar is not submerged in a liquid; and a scavenger blade disposed along the web-transport path upstream of the fluid bar, the scavenger blade spanning the web of media in a cross-track direction and including a sharp blade edge facing the first surface of the web of media, the sharp blade edge being spaced apart from the first surface of the web of media by a gap distance of at least 0.20 mm, wherein the web of media does not contact the scavenger blade and the web of media is not redirected as it passes by the scavenger blade, and wherein the scavenger blade prevents at least some liquid that flows out from the region between the first surface of the web of media and the bearing surface of the fluid bar from reaching portions of the web-transport path that are upstream of the scavenger blade;

wherein the scavenger blade includes a first surface on one side of the sharp blade edge facing towards the fluid bar and a second surface on an opposite side of the sharp blade edge facing away from the fluid bar, wherein the first surface of the scavenger blade is a substantially planar surface and the second surface of the scavenger blade is a curved surface, wherein the first and second surfaces meet to form the sharp blade edge along a leading edge of the scavenger blade, and wherein the scavenger blade draws at least a portion of the liquid that flows out from the region between the first surface of the web of media and the bearing surface of the fluid bar away from the first surface of the web of media as it passes over the sharp blade edge such that at least some of the drawn away portion of the liquid flows down the second surface of the scavenger blade.

15. A web transport system for transporting a web of media along a web-transport path that passes through a tank containing a liquid, comprising:

an input fluid bar disposed along the web-transport path upstream of a position where the web of media enters the liquid in the tank, the web of media being redirected toward the liquid in the tank as it passes the input fluid bar with a first surface of the web of media facing an exterior bearing surface of the input fluid bar, wherein the liquid is pumped through holes in the bearing surface of the input fluid bar and into a region between the first surface of the web of media and the bearing surface of the input fluid bar, thereby pushing the web of media away from the input fluid bar;

an input scavenger blade disposed along the web-transport path upstream of the input fluid bar, the input scavenger blade spanning the web of media in a cross-track direction and including a sharp first sharp blade edge facing the first surface of the web of media, the first sharp blade edge being spaced apart from the first surface of the web of media by a first gap distance of at least 0.20 mm, wherein the web of media does not contact the scavenger blade and the web of media is not redirected as it passes by the scavenger blade, and wherein the input scavenger blade prevents at least some liquid that flows out from the region between the first surface of the web of media and the hearing surface of the input fluid bar from reaching portions of the web-transport path that are upstream of the input scavenger blade;

wherein the input scavenger blade includes a first surface on one side of the first sharp blade edge facing towards the input fluid bar and a second surface on an opposite side of the first sharp blade edge facing away from the input fluid bar, wherein the first surface of the input scavenger blade is a substantially planar surface and the second surface of the input scavenger blade is a curved surface, wherein the first and second surfaces meet to form the sharp blade edge of the input scavenger blade; and an exit fluid bar disposed along the web-transport path downstream of a position where the web of media exits the liquid in the tank, the web of media being redirected as it passes the exit fluid bar with the first surface of the web of media facing an exterior hearing surface of the exit fluid bar, wherein the liquid is pumped through holes in the bearing surface of the exit fluid bar and into a region between the first surface of the web of media and the bearing surface of the exit fluid bar; thereby pushing the web of media away from the exit fluid bar; and an exit scavenger blade disposed along the web-transport path downstream of the exit fluid bar, the exit scavenger blade spanning the web of media in the cross-track direction and including a sharp second sharp blade edge facing the first surface of the web of media, the second sharp blade edge being spaced apart from the first surface of the web of media by a second gap distance of at least 0.20 mm, wherein the web of media does not contact the scavenger blade and the web of media is not redirected as it passes by the scavenger blade, and wherein the exit scavenger blade removes at least some liquid from the first surface of the web of media as it passes by the exit scavenger blade, thereby reducing the amount of liquid that is carried along to portions of the web-transport path that are downstream of the exit scavenger blade;

wherein the exit scavenger blade includes a first surface on one side of the second sharp blade edge facing towards the exit fluid bar and a second surface on an opposite side of the second sharp blade edge facing away from the exit fluid bar, wherein the first surface of the exit scavenger blade is a substantially planar surface and the second surface of the exit scavenger blade is a curved surface, wherein the first and second surfaces meet to form the sharp blade edge along a leading edge of the exit scavenger blade, and wherein the exit scavenger blade draws away at least a portion of the liquid being carried along by the web of media from the first surface of the web of media as it passes over the second sharp blade edge such that at least some of the drawn away portion of the liquid flows down the second surface of the exit scavenger blade.

16. A roll-to-roll liquid processing system for processing a web of media travelling along a web-transport path, comprising:

a first liquid processing tank containing a first processing liquid, wherein the web-transport path carries the web of media through the first processing liquid in the first liquid processing tank;

a first non-submerged fluid bar disposed along the web-transport path downstream of and proximate to a position where the web of media exits the first processing liquid in the first liquid processing tank, the web of media being guided as it passes the first non-submerged fluid bar with a first surface of the web of media facing an exterior bearing surface of the first non-submerged fluid bar, wherein the first processing liquid is pumped through holes in the bearing surface of the first non-submerged fluid bar and into a region between the first surface of the web of media and the bearing surface of the first non-submerged fluid bar, thereby pushing the web of media away from the first non-submerged fluid bar; and a first scavenger blade having a first orientation disposed along the web-transport path downstream of the first non-submerged fluid bar, the first scavenger blade spanning the web of media in a cross-track direction and including a sharp first sharp blade edge facing the first surface of the web of media, the first sharp blade edge being spaced apart from the first surface of the web of media by a first gap distance of at least 0.20 mm, wherein the web of media does not contact the scavenger blade and the web of media is not redirected as it passes by the scavenger blade, and wherein the first scavenger blade removes at least some first processing liquid from the first surface of the web of media as it passes by the first scavenger blade and directs it into the first liquid processing tank, thereby reducing the amount of first processing liquid that is carried along to portions of the web-transport path that are downstream of the first scavenger blade;

wherein the first scavenger blade includes a first surface on one side of the first sharp blade edge facing towards the first non-submerged fluid bar and a second surface on an opposite side of the first sharp blade edge facing away from the first non-submerged fluid bar, wherein the first surface of the first scavenger blade is a substantially planar surface and the second surface of the first scavenger blade is a curved surface, wherein the first and second surfaces meet to form the sharp blade edge along a leading edge of the first scavenger blade, and wherein the first scavenger blade draws away at least a portion of the liquid being carried along by the web of media from the first surface of the web of media as it passes over the first sharp blade edge such that at least some of the drawn away portion of the liquid flows down the second surface of the first scavenger blade;

a second liquid processing tank disposed along the web-transport path downstream of the first liquid processing tank, the second liquid processing tank containing a second processing liquid, wherein the web-transport path carries the web of media through the second processing liquid in the second liquid processing tank;

a second non-submerged fluid bar disposed along the web-transport path upstream of and proximate to a position where the web of media enters the second processing liquid in the second liquid processing tank, the web of media being guided as it passes the second non-submerged fluid bar with a first surface of the web of media facing an exterior bearing surface of the second non-submerged fluid bar, wherein the second processing liquid is pumped through holes in the bearing surface of the second non-submerged fluid bar and into a region between the first surface of the web of media and the bearing surface of the second non-submerged fluid bar, thereby pushing the web of media away from the second non-submerged fluid bar; and a second scavenger blade having a second orientation that is opposite the first orientation, the second scavenger blade being disposed along the web-transport path upstream of the second non-submerged fluid bar, the second scavenger blade spanning the web of media in a cross-track direction and including a sharp second sharp blade edge facing the first surface of the web of media, the second sharp blade edge being spaced apart from the first surface of the web of media by a second gap distance of at least 0.20 mm, wherein the web of media does not contact the scavenger blade and the web of media is not redirected as it passes by the scavenger blade, and wherein the second scavenger blade prevents at least some of the second processing liquid that flows out from the region between the first surface of the web of media and the bearing surface of the second non-submerged fluid bar from reaching portions of the web-transport path that are upstream of the second scavenger blade;

wherein the second scavenger blade includes a first surface on one side of the second sharp blade edge facing towards the second non-submerged fluid bar and a second surface on an opposite side of the second sharp blade edge facing away from the second non-submerged fluid bar, wherein the first surface of the second scavenger blade is a substantially planar surface and the second surface of the second scavenger blade is a curved surface, wherein the first and second surfaces meet to form the sharp blade edge of the second scavenger blade, and wherein the second scavenger blade draws at least a portion of the liquid that flows out from the region between the first surface of the web of media and the bearing surface of the second non-submerged fluid bar away from the first surface of the web of media as it passes over the second sharp blade edge such that at least some of the drawn away portion of the liquid flows down the second surface of the second scavenger blade.

* * * * *